US008810619B2

(12) United States Patent
Kaneoya et al.

(10) Patent No.: US 8,810,619 B2
(45) Date of Patent: Aug. 19, 2014

(54) PRINTER

(75) Inventors: Daisuke Kaneoya, Yamanashi (JP); Tsuyoshi Kubota, Yamanashi (JP); Tatsuzo Aoyagi, Yamanashi (JP); Nobuo Murata, Yamanashi (JP); Shogo Sasuga, Yamanashi (JP); Akira Takei, Yamanashi (JP)

(73) Assignees: Toppan Printing Co., Ltd., Tokyo (JP); Nisca Corporation, Minamikoma-gun, Yamanashi-ken (JP)

( * ) Notice: Subject to any disclaimer, the term of this patent is extended or adjusted under 35 U.S.C. 154(b) by 0 days.

(21) Appl. No.: 13/991,288

(22) PCT Filed: Dec. 7, 2011

(86) PCT No.: PCT/JP2011/078295

§ 371 (c)(1),
(2), (4) Date: Jun. 3, 2013

(87) PCT Pub. No.: WO2012/077709

PCT Pub. Date: Jun. 14, 2012

(65) Prior Publication Data

US 2013/0250026 A1 Sep. 26, 2013

(30) Foreign Application Priority Data

| | | |
|---|---|---|
| Dec. 7, 2010 | (JP) | 2010-272184 |
| Dec. 7, 2010 | (JP) | 2010-272185 |
| Jun. 10, 2011 | (JP) | 2011-129791 |
| Jun. 10, 2011 | (JP) | 2011-129792 |
| Jun. 10, 2011 | (JP) | 2011-129793 |

(51) Int. Cl.
*B41J 2/325* (2006.01)
*B41F 16/00* (2006.01)

(52) U.S. Cl.
CPC ..... *B41J 2/325* (2013.01); *B41F 16/00* (2013.01); *B41F 16/006* (2013.01); *B41F 16/0033* (2013.01)
USPC ..... 347/213

(58) Field of Classification Search
USPC ..... 347/171, 173, 213, 216, 215, 217, 218; 400/120.01
See application file for complete search history.

(56) References Cited

U.S. PATENT DOCUMENTS 6,648,526 B2 * 11/2003 Kobayashi et al. ..... 400/120.01
6,664,993 B2 * 12/2003 Isono ..... 347/213

(Continued)

FOREIGN PATENT DOCUMENTS

JP S63-51162 A 3/1988
JP H04-153068 A 5/1992

(Continued)

OTHER PUBLICATIONS

PCT, "International Search Report for PCT/JP2011/078295", Mar. 6, 2012.

*Primary Examiner* — Huan Tran
(74) *Attorney, Agent, or Firm* — Manabu Kanesaka

(57) ABSTRACT

Provided is a printer capable of ensuring a large peeling angle at the time of peeling between the transfer film and the ink ribbon by differentiating a conveyance direction of the transfer film at a peeling part on a proceeding passage from the proceeding direction. In the printer which forms an image on a transfer film 46 while feeding an ink ribbon 41 and the transfer film 46 to a print position between a platen roller 45 and a thermal head 40 which are mutually pressure-contacted, the transfer film 46 is wound to form a conveyance passage between a feeding spool 48 and a winding spool 47 in a film cassette 100 which is attached to a device frame in a detachably attachable manner, and a film conveying roller 49 and pinch rollers 32*a*, 32*b* are arranged at positions so that the conveyance passage of the transfer film 46 attached to the device frame is displaced to the inside of the cassette by a predetermined amount.

19 Claims, 20 Drawing Sheets

(56) References Cited

U.S. PATENT DOCUMENTS

| | | | | |
|---|---|---|---|---|
| 6,693,655 | B2 * | 2/2004 | Fujimoto et al. | 347/213 |
| 6,781,615 | B2 * | 8/2004 | Tsuruta | 347/213 |
| 6,873,348 | B1 * | 3/2005 | Isono et al. | 347/213 |
| 7,133,059 | B2 * | 11/2006 | Mochizuki et al. | 347/213 |
| 2003/0025780 | A1 * | 2/2003 | Fujimoto et al. | 347/213 |
| 2003/0026635 | A1 | 2/2003 | Tsuruta et al. | |
| 2012/0176460 | A1 * | 7/2012 | Mochizuki et al. | 347/213 |
| 2012/0286464 | A1 * | 11/2012 | Takei et al. | 271/4.01 |
| 2013/0167742 | A1 * | 7/2013 | Tamura et al. | 101/217 |
| 2013/0249164 | A1 * | 9/2013 | Yokoyama et al. | 271/225 |

FOREIGN PATENT DOCUMENTS

| | | | |
|---|---|---|---|
| JP | 2003-26351 | A | 1/2003 |
| JP | 2003-040228 | A | 2/2003 |
| JP | 2004-34658 | A | 2/2004 |
| JP | 3862471 | B2 | 12/2006 |
| JP | 2007-524525 | A | 8/2007 |
| JP | 4334400 | B2 | 9/2009 |

* cited by examiner

PRINTER

RELATED APPLICATIONS

The present application is National Phase of International Application No. PCT/JP2011/078295 filed Dec. 7, 2011, and claims priority from Japanese Applications No. 2010-272184, filed Dec. 7, 2010; No. 2010-272185, filed Dec. 7, 2010; No. 2011-129791, filed Jun. 10, 2011; 2011-129792, filed Jun. 10, 2011; and No. 2011-129793, filed Jun. 10, 2011.

TECHNICAL FIELD

The present invention relates to a printer which records electronic information or image information on a recording medium such as a plastic card and a thick paper card, and relates to improvement of a mechanism which forms an image such as a face photograph and character data on a card surface.

BACKGROUND ART

In general, such a printer has been widely known as a device to record information on a card or the like which is to be used as a card for every kind of identification, a credit card for commercial payment, or the like. Such a card is made of plastic, thick paper, or the like in specific standard sizes. It is configured that the cards (blank cards) are filled into a hopper of the device or that a cassette storing the cards is mounted on the device.

There has been known a retransfer type printer in which an ink image is once formed on a transfer film using a fusible or sublime ink ribbon, and then, the ink image formed on the transfer film is transferred to a card. In this case, it is required that the ink ribbon is peeled from the transfer film to perform transferring on the card after the ink image is formed on the transfer film.

In a case of performing such peeling, it is possible to avoid that a part of the transfer film remains on the transfer film when the transfer film and the ink ribbon are separated at a large angle, for example, at approximate right angle. Thus, peeling can be reliably performed.

CITED LITERATURE

Patent Literature

Patent Literature 1: Japanese Patent No. 4334400
Patent Literature 2: Japanese Patent No. 3862471
Patent Literature 3: Japanese Patent Application Laid-Open No. 2003-26351
Patent Literature 4: Japanese Patent Application Laid-Open No. 2007-524525

SUMMARY OF THE INVENTION

Problems to be Solved by the Invention

Here, when the transfer film and the ink ribbon are to be separated at a large angle, the ink ribbon is required to be conveyed in a direction perpendicular to a proceeding direction of the transfer film. Accordingly, there arises a problem that the device is upsized as requiring space in the direction.

In view of the above, an object of the present invention is to provide a printer capable of ensuring a large peeling angle at the time of peeling between the transfer film and the ink ribbon by differentiating a conveyance direction of the transfer film at a peeling part on a proceeding passage from the proceeding direction.

Means for Solving the Problem

To address the above issues, the present invention provides a printer in which an ink ribbon and a transfer film are fed to a print position between a platen roller and a thermal head which are mutually pressure-contacted and an image is formed on the transfer film including a feeding spool which winds an unused portion of the transfer film, a winding spool which winds a used portion of the transfer film, a film cassette which holds the feeding spool and the winding spool as being detachably attachable to a device frame, a peeling member which separates the transfer film and the ink ribbon from an overlapped state and conveys the transfer film and the ink ribbon respectively in two different directions as being arranged at the downstream side of the platen roller, a film conveying roller which is fixedly arranged at the downstream side of the peeling member and at the inside of the film cassette with respect to the transfer film, a pinch roller which is arranged at a position being faced to the film conveying roller while sandwiching the transfer film and which is movable between a pressure-contact position to cause the transfer film to be pressure-contacted to the film conveying roller and a separation position to be separated from the transfer film, and drive means which rotationally drives the film conveying roller. Here, the transfer film is displaced by a predetermined amount to the inside of the film cassette and is pressure-contacted to the film conveying roller by moving the pinch roller from the separation position to the pressure-contact position, and the image is formed on the transfer film while the transfer film is conveyed with rotation of the film conveying roller.

Here, the platen roller is arranged at the inside of the film cassette with respect to the transfer film, the thermal head is fixedly arranged at a position being faced to the platen roller as sandwiching the transfer film and the ink ribbon, the platen roller is configured to be movable between a non-print position where the platen roller is separated from the transfer film and the print position where the image is formed on the transfer film while nipping the transfer film and the ink ribbon with thermal head, and the transfer film is displaced to the outside of the cassette film by a predetermined amount by moving the platen roller from the non-print position to the print position.

Further, the platen roller is held by a first bracket which advances toward the thermal head with rotation of a first cam, the pinch roller which is structured with a pair of pinch rollers arranged at the upstream side and the downstream side along a film conveyance passage for conveying the transfer film and which is held by a second bracket which advances toward the film conveying roller with rotation of a second cam, a first spring member which urges the platen roller held by the first bracket to be pressed to the thermal head and a second spring member which urges the pair of pinch rollers held by the second bracket to be pressed to the film conveying roller are provided, the film conveying roller, the first cam, and the first bracket are integrated as a first unit, and the second cam and the second bracket are integrated as a second unit.

Here, the peeling member includes a pair of rollers which nip the transfer film and the ink ribbon in an overlapped state, and one roller is arranged as being capable of being pressure-contacted to and separated from the other roller and is pressure-contacted and separated as being interlocked with the platen roller which moves from the non-print position to the print position. Alternatively, the peeling member includes a pair of rollers which nip the transfer film and the ink ribbon in an overlapped state, and one roller is arranged as being capable of being pressure-contacted to and separated from the other roller while being held by the first bracket and is pressure-contacted and separated as being interlocked with the platen roller which moves from the non-print position to the print position.

Here, contacting-separating motion of the platen roller against the thermal head and the contacting-separating motion of the pinch roller against the film conveying roller are caused by a common drive source. Further, the first cam and the second cam are driven by a common drive source.

Further, the thermal head is arranged as a third unit.

Here, the platen roller is held by a pair of platen support members which supports both ends of the platen roller respectively, and the platen support members are held by the first bracket via the first spring member. Then, the first bracket and the platen support members are interlocked as having space in which the first cam and the first spring member are arranged.

Further, the pair of pinch rollers are supported by both ends of a pinch roller support member which is held rotatably at a center part thereof by the second bracket. Then, one end of the second bracket which is supported axially at a midpoint thereof moves the supported pinch roller support member toward the film conveying roller when the second bracket is rotated with the other end thereof urged by the second cam.

Further, the second bracket includes a tension receiving member which is contacted to the transfer film so as to absorb a tensile force of the transfer film being repulsive to pressure-contact when the pinch roller is pressure-contacted to the film conveying roller via the transfer film.

Here, a friction coefficient of the film conveying roller against the transfer film is set higher than a friction coefficient of the platen roller against the transfer film. Further, hardness of the platen roller is set higher than hardness of the film conveying roller.

Further, a guide roller which conveys the ink ribbon and the transfer film to the print position in an overlapped state is arranged at the upstream side of the platen roller, and then, a pressure-contact point between the platen roller and the thermal head is arranged at a position being offset by a predetermined amount to the outside of the film cassette and a pressure-contact point between the film conveying roller and the pinch roller is offset by a predetermined amount to the inside of the film cassette, with respect to a line connecting the guide roller and the peeling roller.

Further, the other roller of the peeling member is fixed to a ribbon cassette which stores the ink ribbon.

Further, the ink ribbon peeled by the peeling member is wound in an oblique direction toward the outside of the film cassette, and the transfer film and the ink ribbon passed through the peeling member are conveyed in mutually separating directions.

Furthermore, a winding roll of the ink ribbon is arranged at a position being faced to the film conveying roller as sandwiching the pinch roller at the separation position.

Advantageous Effects of the Invention

According to the printer of the present invention, the conveyance direction of the film conveying roller can be shifted at the peeling part between the transfer film and the ink ribbon. Accordingly, the transfer film and the ink ribbon can be separated at a large angle without upsizing the device and reliable peeling can be performed.

EMBODIMENTS OF THE INVENTION

Figure 1:
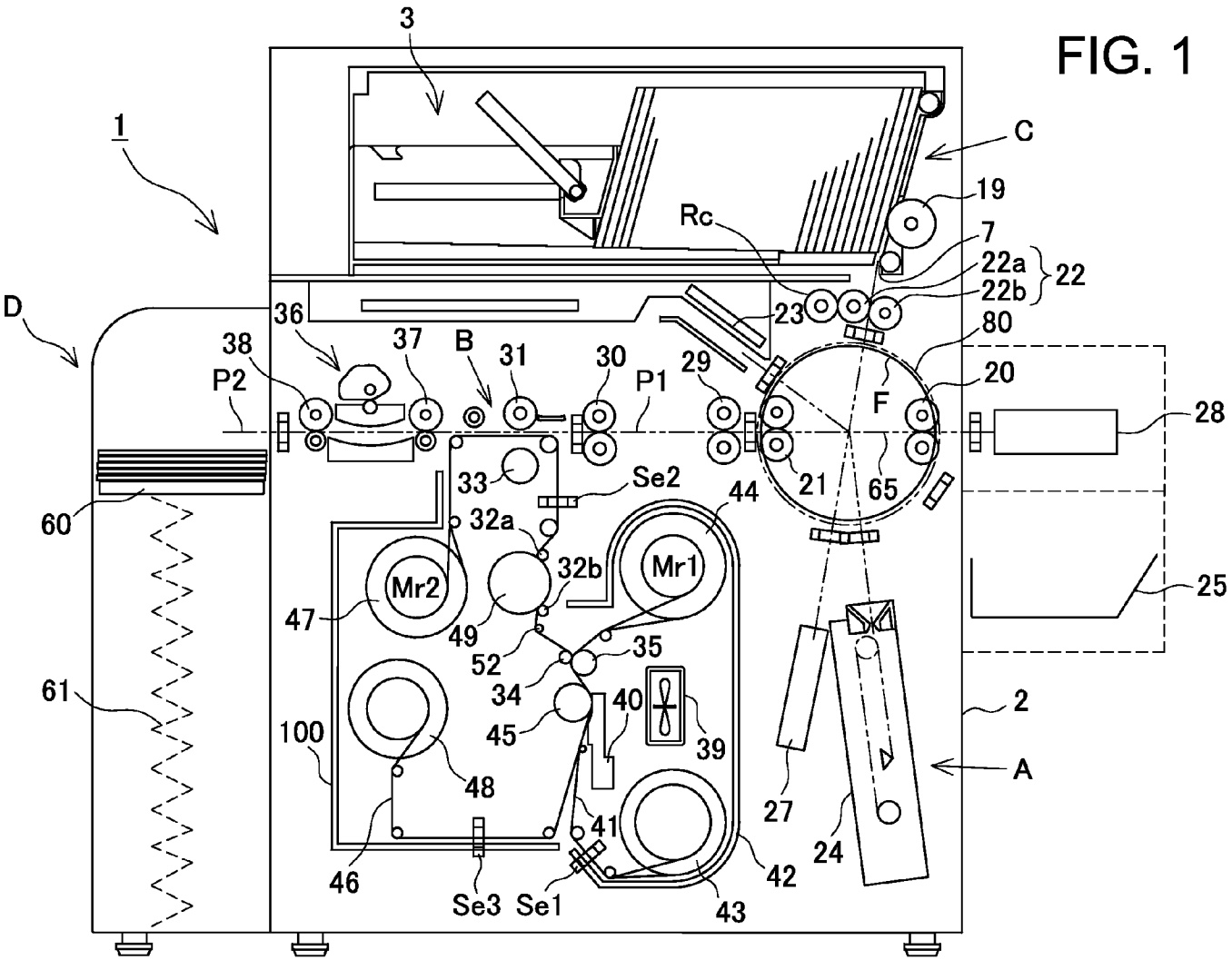
FIG. 1 is a view illustrating a whole structure of an embodiment of a printer according to the present invention.

In the following, the present invention will be described in detail based on preferable embodiments. FIG. 1 is a view illustrating a whole structure of a printer 1 according to the present invention. The printer 1 records information on a card such as an ID card for every kind of identification and a credit card for commercial dealings. A device housing 2 is provided with an information recording section A, an image forming section B, a medium storing section C, and a storage section D.

The information recording section A is structured with a magnetic recording portion 24, a non-contact type IC recording portion 23, and a contact type IC recording portion 27.

The medium storing section C is structured with a card cassette 3 which aligns and stores a plurality of cards in standing posture as being separately arranged from the device housing 2. A separating opening 7 is formed at the front end of the card cassette 3 so that a card at the frontmost row is discharged and fed by a pickup roller 19.

The fed card is conveyed to a turning unit F after dust on a card surface is firstly removed by an introducing roller (contact roller) 22. The contact roller 22 is structured with a first roller 22*a* and a second roller 22*b* being a pair which removes dust on a card surface as being contacted to the card surface while sandwiching and feeding the card. A cleaning roller Rc is contacted to the first roller 22*a* to remove dust stuck to a surface of the first roller 22*a*. The contact roller 22 and the cleaning roller Rc are detachably attachable to the device for replacement and maintenance. Details thereof will be described later.

The turning unit F is structured with a rotary frame 80 which is swingably bearing-supported by the device housing 2 and two roller pairs 20, 21 which are supported by the rotary frame 80. Then, the roller pairs 20, 21 are axially supported by the rotary frame 80. The rotary frame 80 is swung in a direction of a predetermined angle by a turning motor (pulse motor or the like) and the roller pairs 20, 21 attached thereto are configured to be rotated in forward and reverse directions by a conveying motor. A drive mechanism for the above (not illustrated) may be configured to perform switching with a clutch between swinging of the rotary frame 80 and rotating of the roller pairs 20, 21 with one pulse motor or to separately operate swinging of the rotary frame 80 and rotating of the roller pairs 20, 21.

The magnetic recording portion 24, the non-contact type IC recording portion 23, and the contact type IC recording portion 27 are arranged at a periphery of swinging of the turning unit F. The roller pairs 20, 21 form a medium introduction passage 65 for conveying toward any of the information recording portions 23, 24, 27. In the drawing, a bar code reader 28 is a unit which performs right-wrong determination (error determination), for example, while reading a later-mentioned bar code printed at the image forming section B.

When a card with posture deflected into a direction of a predetermined angle by the turning unit F is conveyed to the magnetic recording portion 24, the non-contact type IC recording portion 23, or the contact type IC recording portion 27 through the medium introduction passage 65 formed by the roller pairs 20, 21, inputting can be performed on a card magnetically or electronically. Here, when a recording error occurs at the information recording portion 23, 24, 27, the card is discharged to a reject stacker 25.

The image forming section B forms an image such as a face photograph and character data on front and back faces of a card. A medium conveyance passage P1 for conveying a card is arranged on an extension of the medium introduction passage 65. Further, conveying rollers 29, 30 which convey a card are arranged at the medium conveyance passage P1 and are connected to a conveying motor (not illustrated).

The image forming section B includes a film-shaped medium conveying device, a primary transfer portion which firstly performs printing an image using a thermal head 40 on a transfer film 46 conveyed by the conveying device, and a secondary transfer portion which subsequently performs printing the image printed on the transfer film 46 on a surface of a card existing on the medium conveyance passage P1 using a heat roller 33.

A medium conveyance passage P2 for conveying a printed card into a storage stacker 60 is arranged at the downstream side of the image forming section B. Conveying rollers 37, 38 which convey a card are arranged at the medium conveyance passage P2 and are connected to a conveying motor (not illustrated).

A de-curl mechanism 36 is arranged between the conveying roller 37 and the conveying roller 38 and corrects a curl caused by thermal transfer of the heat roller 33 by pressing a center part of a card held between the conveying rollers 37, 38. The de-curl mechanism 36 is configured to be movable in the up-down direction in FIG. 1 with a lifting and lowering mechanism (not illustrated) such as a cam.

The storage section D is configured to store cards conveyed from the image forming section B at the storage stacker 60. The storage stacker 60 is configured to be moved to the lower side in FIG. 1 by a lifting and lowering mechanism 61.

In the following, description will be performed more specifically on the image forming section B according to the present invention among the whole structure of the printer 1.

The transfer film 46 is wound to a winding roll 47 and a feeding roll 48 of the film cassette 100 which are rotated with operation of a motor Mr2. The transfer film 46 is routed so as to convey a transfer image to a platen roller 31 and the heat roller 33. A film conveying roller 49 being a main drive roller which conveys the transfer film 46 is arranged as being fixed inside the film cassette 100. A conveyance amount and a conveyance stop position of the transfer film 46 are determined by controlling operation of the roller 49. The motor Mr2 is operated as well during operation of the film conveying roller 49. Here, the operation thereof is for winding the fed transfer film 46 by the winding roll 47 and is not for driving the transfer film 46 not like a main entity for conveyance.

The transfer film 46 is moved counterclockwise in FIG. 1 at constant speed along with an ink ribbon 41. Here, a friction coefficient of the film conveying roller 49 against the transfer film 46 is set higher than a friction coefficient of the platen roller 31 against the transfer film 46.

Pinch rollers 32*a*, 32*b* are arranged at a circumference of the film conveying roller 49. Not illustrated in FIG. 1, the pinch rollers 32*a*, 32*b* are movably arranged to advance to and retreat from the film conveying roller 49. The drawing illustrates a state that the transfer film 46 is wound to the film conveying roller 49 by advancing to be pressure-contacted to the film conveying roller 49. Accordingly, the transfer film is conveyed having accurate distance corresponding to rotation of the film conveying roller 49.

The ink ribbon 41 is stored in a cassette (ribbon cassette) 42. The cassette 42 contains a feeding roll (feeding spool) 43 and a winding roll (winding spool) 44. The winding roll 44 is driven by a motor Mr1.

A platen roller 45 and the thermal head 40 structure a primary transfer portion. The thermal head 40 is arranged at a position being faced to the platen roller 45. The thermal head 40 is thermally controlled by a head control IC (not illustrated) in accordance with image data, so that an image is printed on the transfer film 46 using the ink cartridge 41 being a sublimation type. Here, a cooling fan 39 is for cooling the thermal head 40.

The ink ribbon 41 which has finished printing on the transfer film 46 is peeled from the transfer film 46 by a pair of peeling members 34, 35. The pair of peeling members 34, 35 are structured with a peeling roller (peeling koro) 34 and a pinch roller 35. The pinch roller 35 is fixed to the cassette 42. The peeling roller 34 is arranged as being capable of being pressure-contacted to and separated from the fixed pinch roller 35.

With respect to a line connecting the pair of peeling members 34, 35 and a guide roller at the upstream side of the platen roller 45 for conveying the ink ribbon 41 and the transfer film 46 to a print position in an overlapped state, a pressure-contact point between the platen roller 45 and the thermal head 40 is arranged at a position being offset by a predetermined amount to the outside of the film cassette 100 and a pressure-contact point between the film conveying roller 49 and the pinch roller 32 is offset by a predetermined amount to the inside of the film cassette 100.

Figure 5:
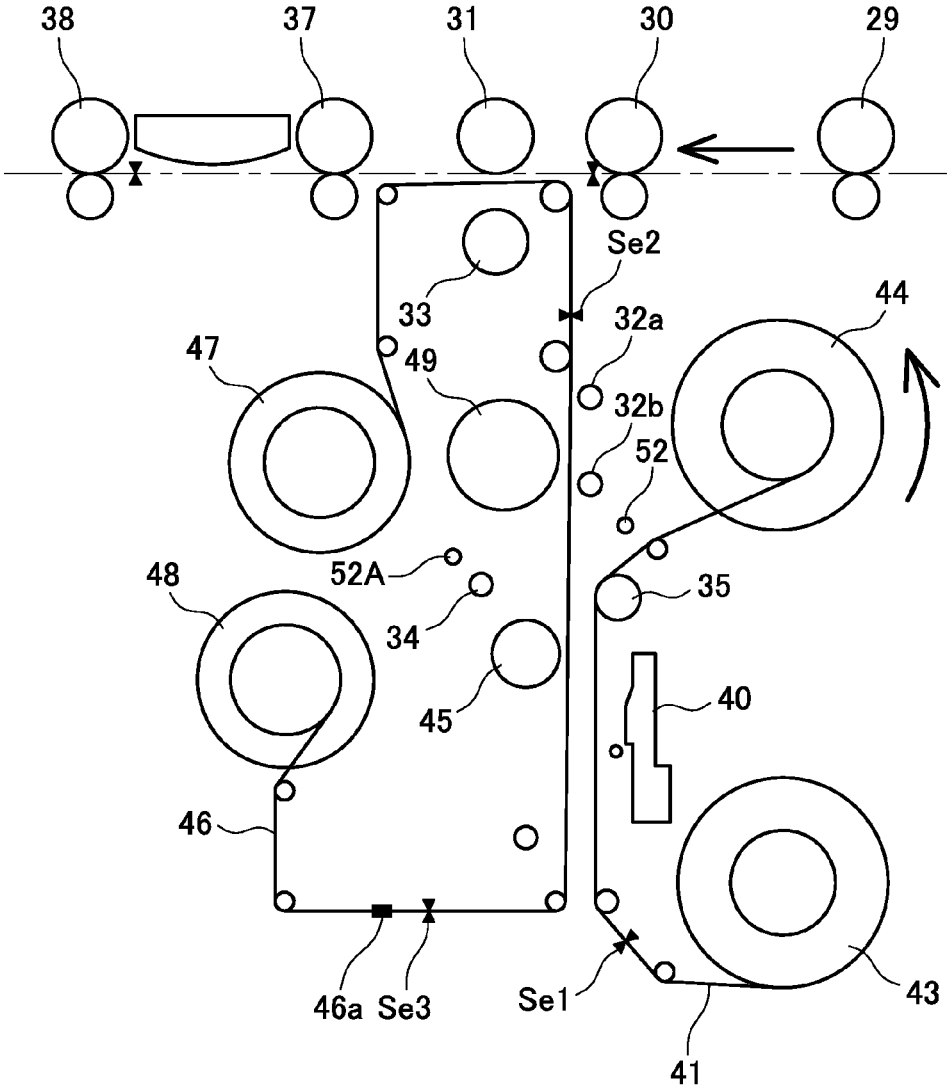
FIG. 5 is an explanatory operational view illustrating a state of the standby position of the printer.
Figure 6:
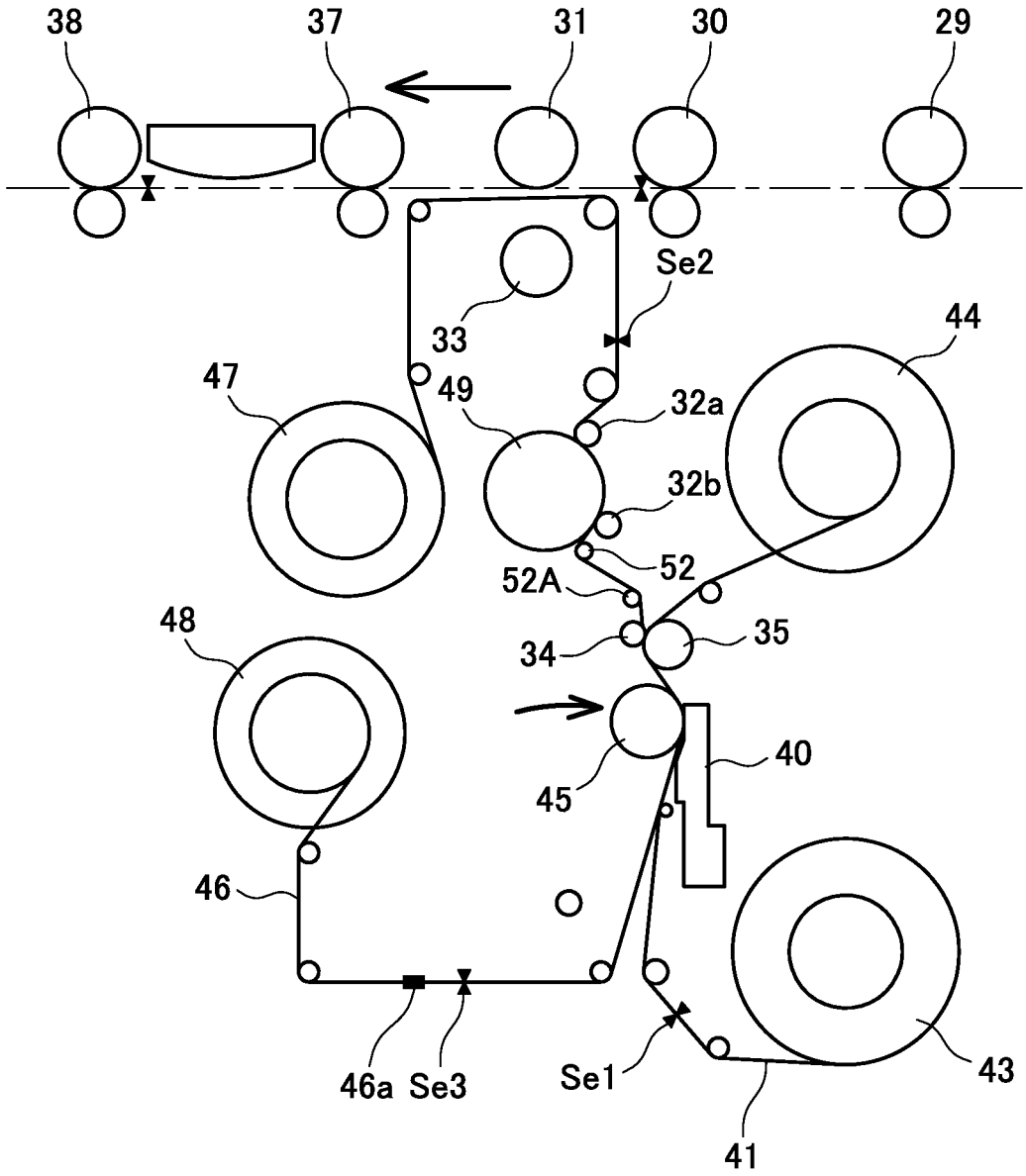
FIG. 6 is an explanatory operational view illustrating a state of the conveyance position of the printer.

Here, the film cassette 100 forms a film passage of the transfer film 46 with a plurality of guide shafts. FIG. 5 illustrates the film passage in an initial state. With respect to the film passage in the initial state (i.e., a line connecting guide shafts arranged at the upstream side and the downstream side of the film conveying roller 49 and the platen roller 45), the pressure-contact point between the platen roller 45 and the thermal head 40 may be arranged at a position being offset by a predetermined amount to the outside of the film cassette 100 and the pressure-contact points between the film conveying rollers 49 and the pinch rollers 32*a*, 32*b* may be arranged at positions being offset by predetermined amounts to the inside of the film cassette 100 (see FIG. 6). Further, it is preferable that the pressure-contact point between the peeling roller 34 and the pinch roller 35 is arranged at a point being offset by a predetermined amount to the outside (the thermal head 40 side) of the film cassette 100 with respect to the film passage in the initial state. Owing to that the film passage in the initial state as illustrated in FIG. 5 is displaced to form the film conveyance passage for image forming as illustrated in FIG. 6, a peeling angle between the transfer film 46 and the ink ribbon 42 can be enlarged.

Further, the peeled ink ribbon 42 after passing the pressure-contact point between the peeling roller 34 and the pinch roller 35 is conveyed to a side opposed to the film conveying roller 49 (the outside of the film cassette 100) in a direction oblique to the film passage in the initial state, so that the peeling angle is set approximately to 90 degrees. In the present embodiment, the winding roll 44 of the ink ribbon 42 is arranged in a range which is defined by the direction of the film passage in the initial state and the direction perpendicular thereto around the pinch roller 35 (in the present embodiment, at a position being faced to the film conveying roller 49 as sandwiching the pinch rollers 32*a*, 32*b* in a separation position of FIG. 5), so that the peeled ink ribbon 42 is wound in a direction being oblique within the range. According to the above, the transfer film 46 and the ink ribbon 42 after peeling are wound in directions to be separated as being mutually oblique with respect to the film passage in the initial state. Accordingly, the peeling angle can be enlarged (separation can be performed in approximately perpendicular directions) and the device can be prevented from being upsized in the width direction.

Here, it is also possible that the pressure-contact point between the platen roller 45 and the thermal head 40, the pressure-contact point between the peeling roller 34 and the pinch roller 35, and the pressure-contact point between the film conveying roller 49 and the pinch roller 32 are aligned on an approximately straight line and that the ink ribbon 42 is peeled in a direction being approximately perpendicular to the straight line. Owing to that the respective pressure-contact points are aligned on an approximately straight line at the time of image forming, it is possible to lessen a force of the transfer film 46 to release pressure-contacting between the peeling roller 34 and the pinch roller 35. Accordingly, nipping between the peeling roller 34 and the pinch roller 35 are reliably performed and a peeling position can be appropriately maintained.

At the time of printing, the peeling roller 34 is moved to the pinch roller 35 side and the transfer film 46 and the ink ribbon 41 are nipped by both thereof, so that the peeling is performed. Then, the peeled ink ribbon 41 is wound by the winding roll 44 with driving of the motor Mr1. The transfer film 46 is conveyed to a secondary transfer portion including the platen roller 31 and the heat roller 33 by the film conveying roller 49. At the secondary transfer portion, the transfer film 46 and a card are nipped by the heat roller 33 and the platen roller 31 and the image on the transfer film 46 is transferred onto a surface of the card. Here, the heat roller 33 is attached to a lifting and lowering mechanism (not illustrated) to be pressure-contacted to and separated from the platen roller 31 via the transfer film 46. The heat roller 33 is structured with a heating roller and transfers an image on the transfer film 46 to a card surface with heating means which is arranged at the inside thereof. The drawing illustrates a position detecting sensor Se1 for the ink ribbon 41, and an existence detection sensor Se1 and a position detecting sensor Se3 for the transfer film 46.

Figure 2:
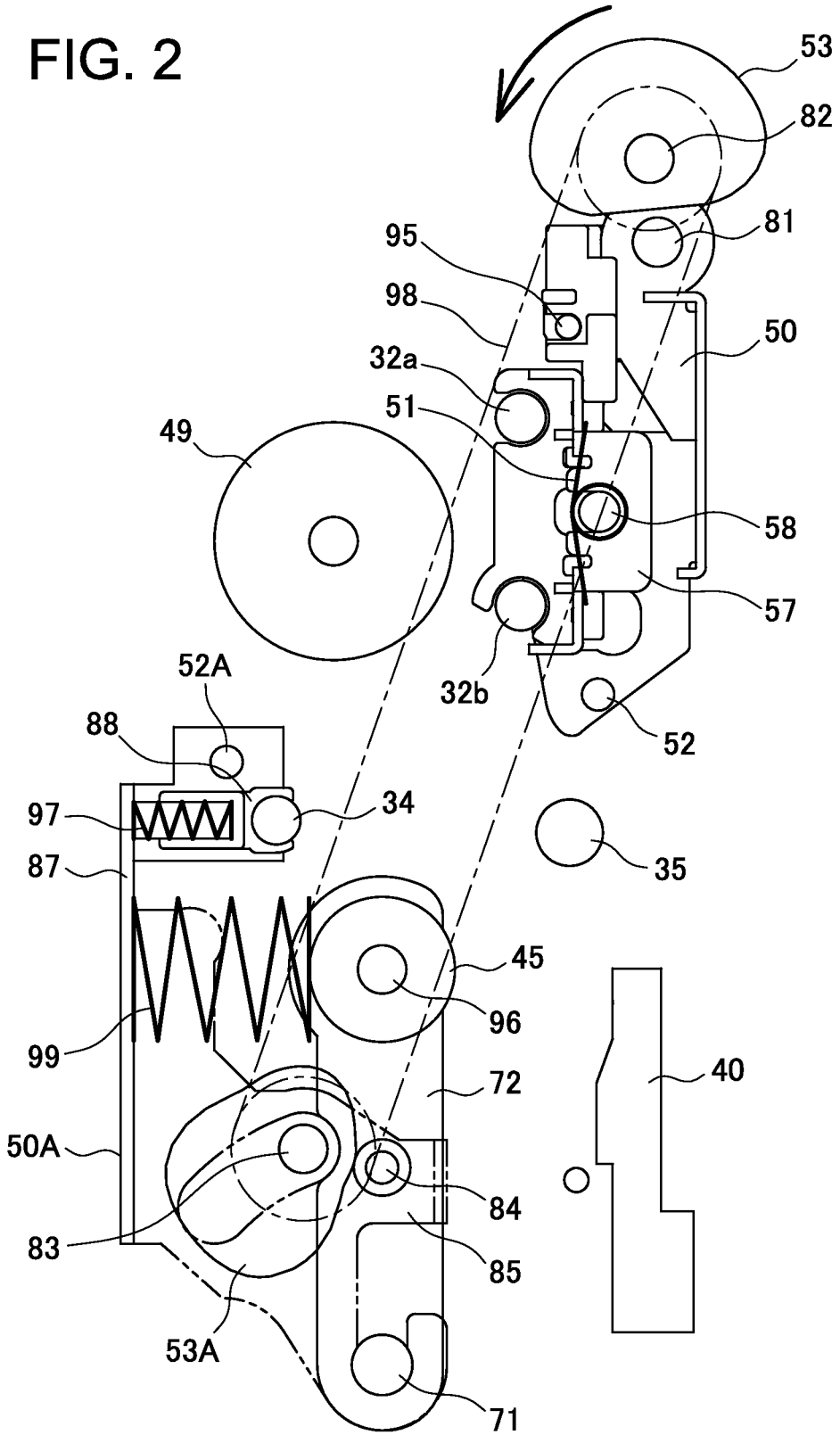
FIG. 2 is an explanatory view illustrating a control state with cams at a standby position where a pinch roller and a film conveying roller are separated and a platen roller and a thermal head are separated.
Figure 3:
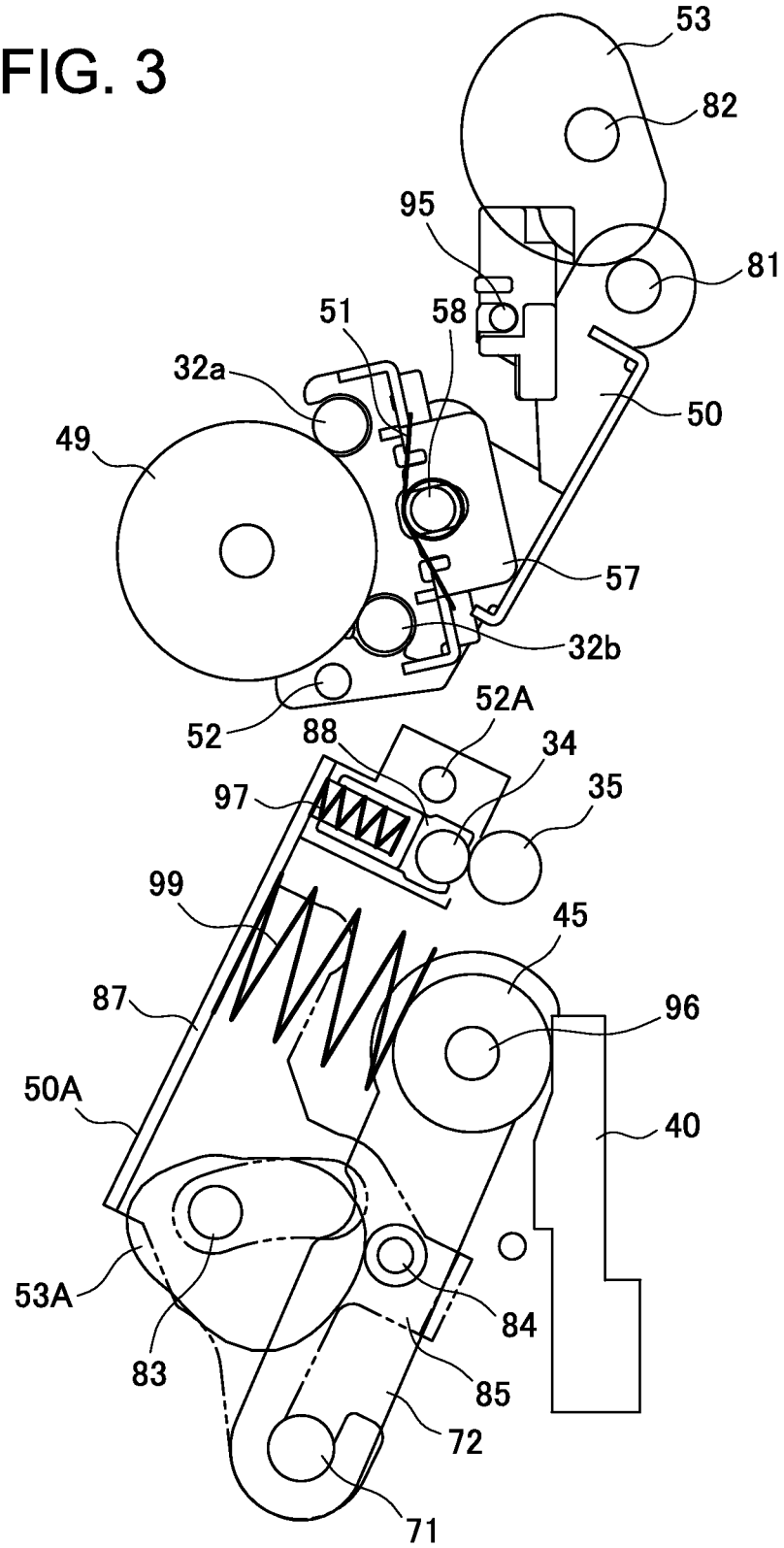
FIG. 3 is an explanatory view illustrating a control state with the cams at a print position where the pinch roller and the film conveying roller are contacted and the platen roller and the thermal head are contacted.
Figure 4:
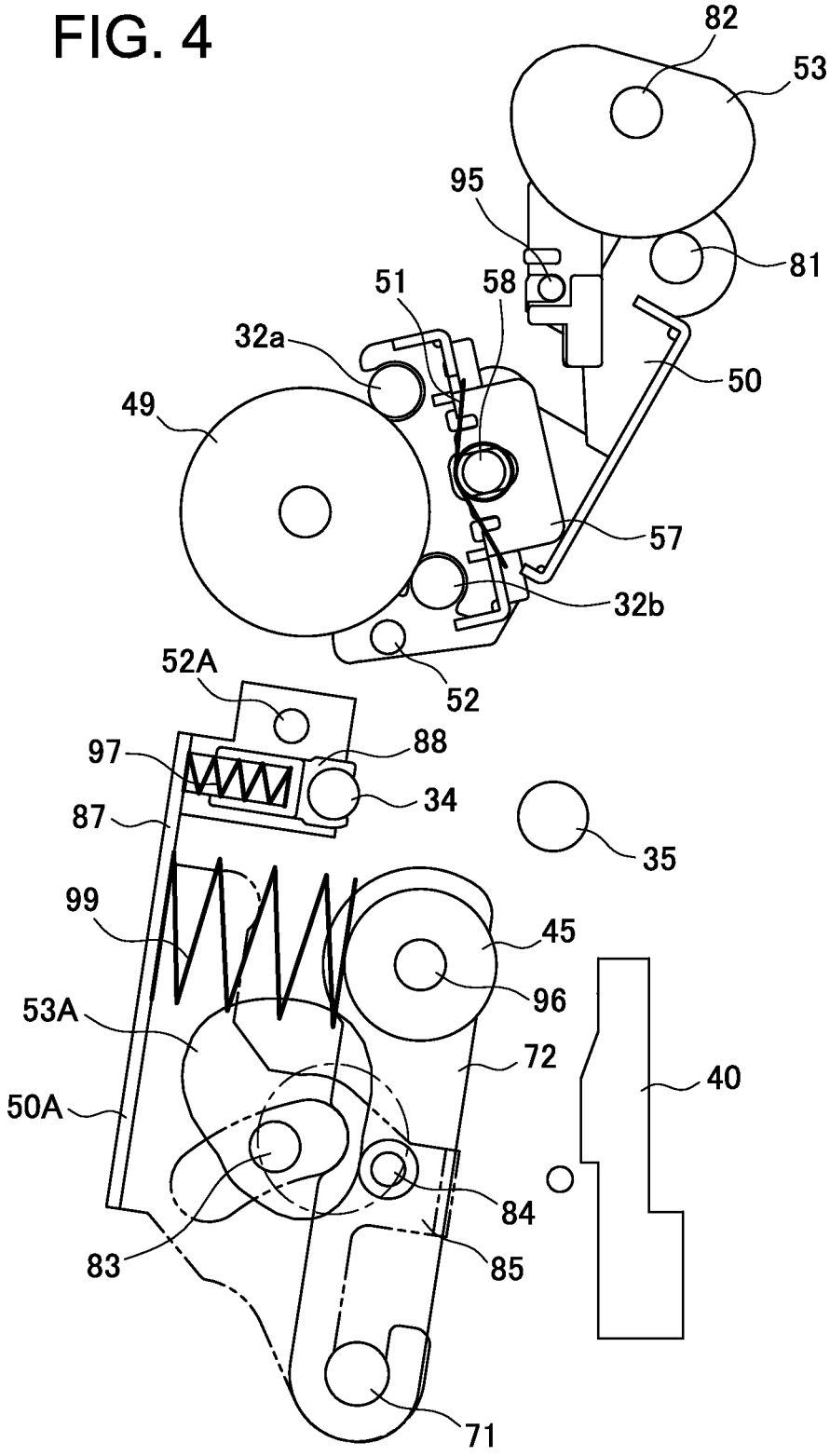
FIG. 4 is an explanatory view illustrating a control state with the cams at a conveyance position where the pinch roller and the film conveying roller are contacted and the platen roller and the thermal head are contacted.
Figure 9:
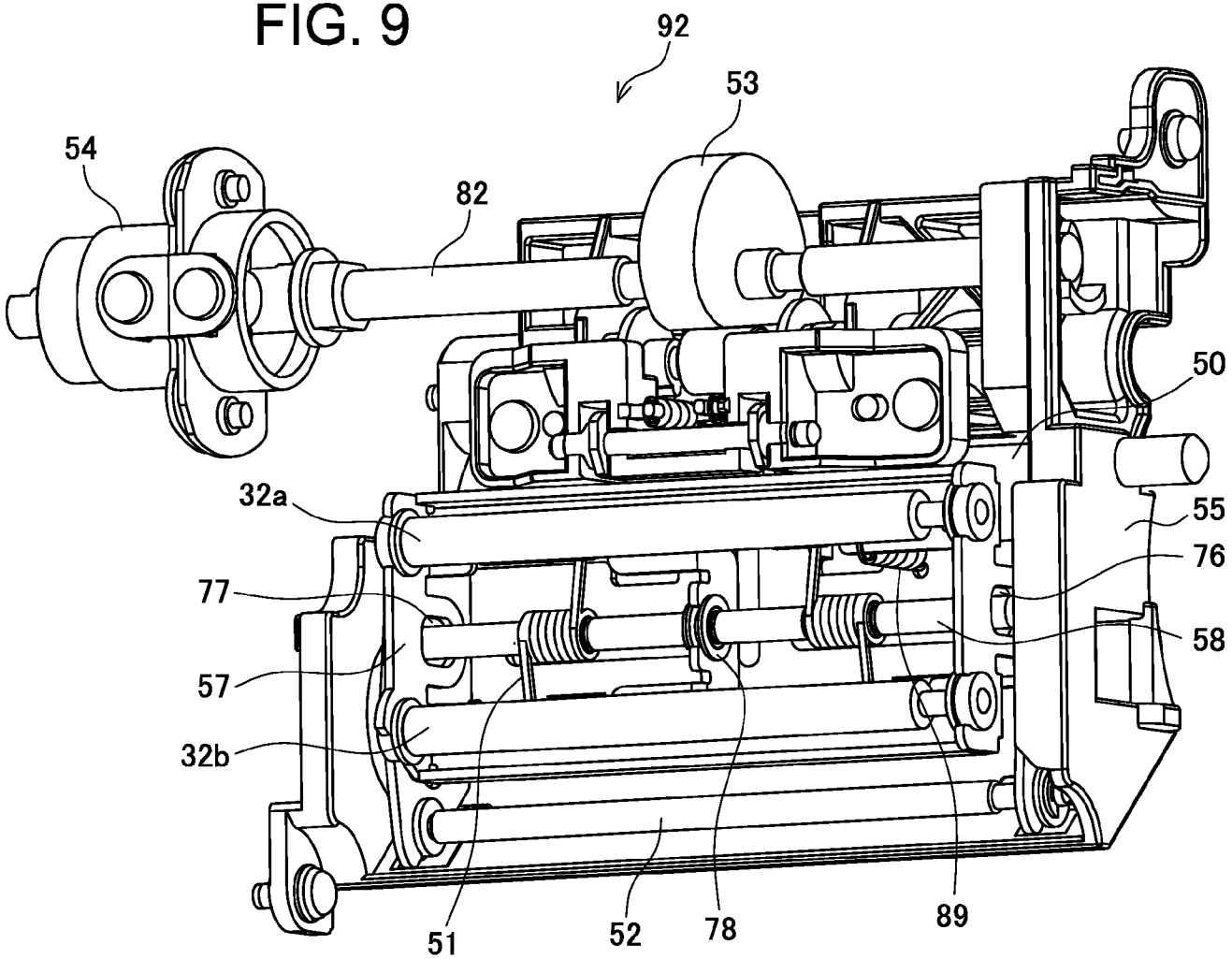
FIG. 9 is an external view illustrating a structure of a second unit integrating the pinch roller and peripheral parts thereof for assembling into the printer.

In the following, a structure of the primary transfer portion will be further described in detail along with operations thereof. As illustrated in FIGS. 2 to 4, the pinch rollers 32*a*, 32*b* are supported at an upper end part and a lower end part of a pinch roller support member 57 respectively. The pinch roller support member 57 is rotatably supported by a support shaft 58 which penetrates a center part thereof. As illustrated in FIG. 9, regarding the support shaft 58, both end parts thereof are bridged to elongated holes 76, 77 which are formed at the pinch roller support member 57 and a middle part thereof is fixed to a fixing portion 78 of a bracket 50. The elongated holes 76, 77 provide space against the support shaft 58 in the horizontal direction and the vertical direction. The above structure enables later-mentioned adjustment of the pinch rollers 32*a*, 32*b* against the film conveying roller 49.

Then, spring members 51 (51*a*, 51*b*) are attached to the support shaft 58. End parts of the pinch roller support member 57 where the pinch rollers 32*a*, 32*b* are mounted are urged toward the film conveying roller 49 by a spring force as being contacted to the spring member 51 respectively.

The bracket 50 is contacted to a cam operation face of a cam 53 at a cam receiver 81 thereof and is configured to move in the right-left direction in the drawing against the film conveying roller 49 in accordance with rotation of the cam 53 about a cam shaft 82 in the direction of an arrow as being driven by a drive motor (illustrated in FIG. 9). Accordingly, when the bracket 50 advances toward the film conveying roller 49 (see FIGS. 3 and 4), the pinch rollers 32*a*, 32*b* are pressure-contacted to the film conveying roller 49 against the spring member 51 as sandwiching the transfer film 46, so that the transfer film 46 is wound to the film conveying roller 49.

At that time, the pinch roller 32*b* which is located at a position farther from an axis 95 being the rotation axis of the bracket 50 is firstly pressure-contacted to the film conveying roller 49 and the pinch roller 32*a* is subsequently pressure-contacted thereto. In this manner, owing to that the axis 95 being the rotation axis is located above the film conveying roller 49, the contact with the film conveying roller 49 is caused while the pinch roller support member 57 is rotated not being parallely-moved. Accordingly, there is an advantage to save space in the width direction compared to a case with parallel motion.

Further, a pressure-contact force when the pinch rollers 32*a*, 32*b* are pressure-contacted to the film conveying roller 49 becomes even with the spring member 51 in the width direction of the transfer film 46. At that time, since the elongated holes 76, 77 are formed at both sides of the pinch roller support member 57 and the support shaft 58 is fixed by the fixing portion 78, the pinch roller support member 57 can be adjusted in three directions. Accordingly, the transfer film 46 is conveyed with rotation of the film conveying roller 49 in appropriate posture without causing skew. Here, the adjustment in three directions denotes the followings. That is, (i) adjustment of parallelism of axes of the pinch rollers 32*a*, 32*b* in the horizontal direction with respect to an axis of the film conveying roller 49 to equalize the pressure-contact force of the pinch rollers 32*a*, 32*b* in the axis direction against the film conveying roller 49, (ii) adjustment of movement distance of the pinch roller 32*a* and the pinch roller 32*b* with respect to the film conveying roller 49 to equalize the pressure-contact force of the pinch roller 32*a* against the film conveying roller 49 and the pressure-contact force of the pinch roller 32*b* against the film conveying roller 49, and (iii) adjustment of parallelism of the axes of the pinch rollers 32*a*, 32*b* in the vertical direction with respect to the axis of the film conveying roller 49 so that the axes of the pinch rollers 32*a*, 32*b* becomes vertical against the film proceeding direction.

The bracket 50 is provided with a tension receiving member 52 contacted to a part of the transfer film 46 which is not wound to the film conveying roller 49 when the bracket 50 advances toward the film conveying roller 49.

The tension receiving member 52 is arranged so that a tensile force of the transfer film 46 generated when the pinch rollers 32*a*, 32*b* cause the transfer film 46 to be pressure-contacted to the film conveying roller 49 prevents the pinch rollers 32*a*, 32*b* respectively from retreating from the film conveying roller 49 against the urging force of the spring member 51. Therefore, the tension receiving member 52 is attached to a distal end at a rotation-side end part of the bracket 50 so as to be contacted to the transfer film 46 at a position being further left side in the drawing than the pinch rollers 32*a*, 32*b*. FIG. 1 illustrates a state in which the tension receiving member 52 is contacted to the transfer film 46.

According to the above, the tensile force generated by elasticity of the transfer film 46 is directly received by the cam 53 via the tension receiving member 52. Therefore, since the tensile force prevents the pinch rollers 32*a*, 32*b* from retreating from the film conveying roller 49 and the pressure-contact force of the pinch rollers 32*a*, 32*b* from being weakened, accurate conveyance can be performed while maintaining a state that the transfer film 46 is intimately contacted and wound to the film conveying roller 49.

Figure 8:
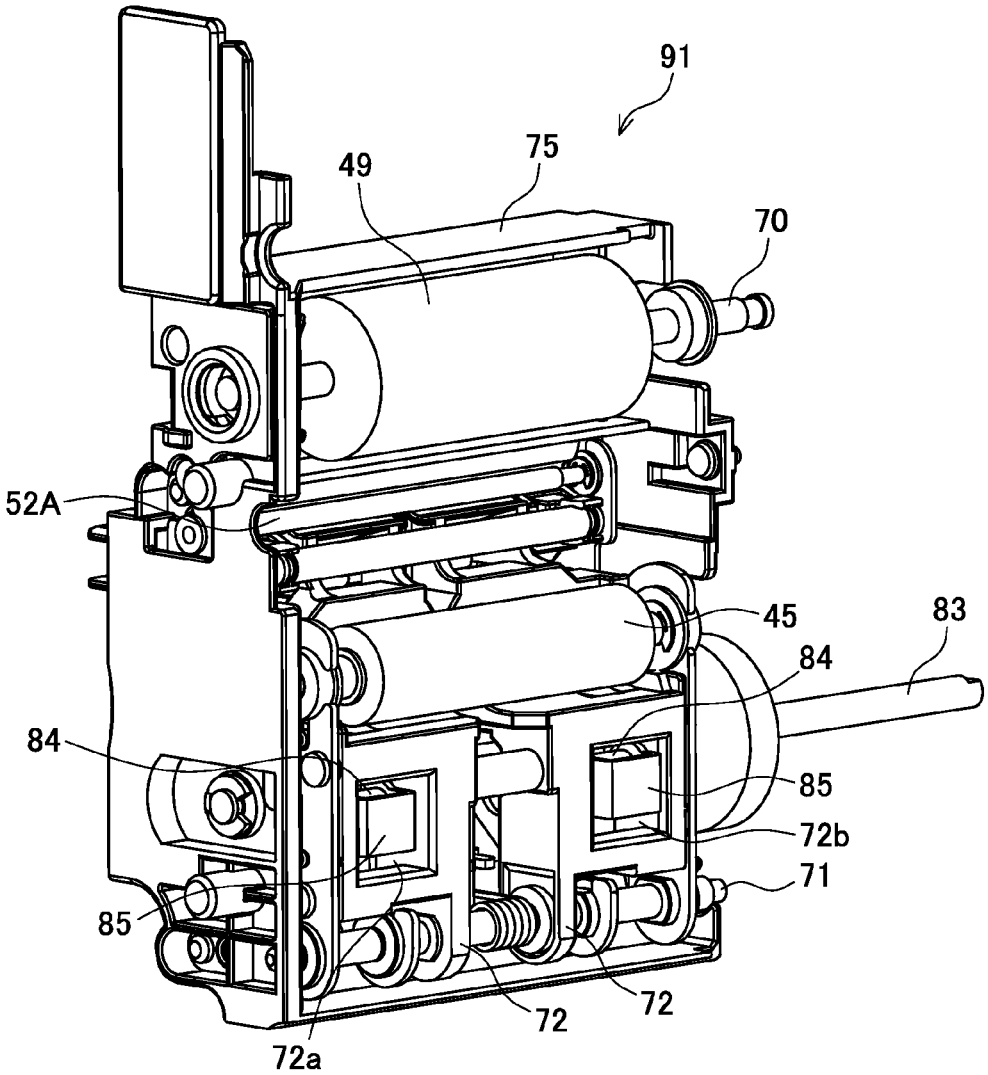
FIG. 8 is an external view illustrating a structure of a first unit integrating the film conveying roller, the platen roller, and peripheral parts thereof for assembling into the printer.

As illustrated in FIG. 8, the platen roller 45 which is arranged along the width direction of the transfer film 46 is supported by a pair of platen support members 72 which are rotatable about a shaft 71. The pair of platen support members 72 support both ends of the platen roller 45. The platen support members 72 are connected respectively to ends of a bracket 50A having the shaft 71 as the common rotational axis via a spring member 99. Further, the platen roller 45 is axially supported by a shaft 96 in a rotatable manner.

The bracket 50A includes a base plate 87 and a cam receiver support portion 85 formed as being bent from the base plate 87 in a direction toward the platen support member 72. The cam receiver support portion 85 supports a cam receiver 84. A cam 53A rotating about a cam shaft 83 which is driven by a drive motor 54 (illustrated in FIG. 9) is arranged between the base plate 87 and the cam receiver support portion 85, so that the cam receiver 84 is contacted to a cam operation face. Accordingly, when the bracket 50A advances toward the thermal head 40 with rotation of the cam 53A, the platen support member is moved as well and the platen roller 45 is pressure-contacted to the thermal head 40.

As a result of that the spring member 99 and the cam 53A are arranged at the upper and lower sides between the bracket 50A and the platen support member 72 as described above, the platen moving unit can be arranged in a space between the bracket 50A and the platen support member 72. Further, in the width direction, it is possible to arrange within the width of the platen roller 45. Thus, space saving can be achieved.

Further, the cam receiver support portion 85 is fitted to a hole portion 72*a*, 72*b* (illustrated in FIG. 8) formed at the platen support member 72. Accordingly, even if the cam receiver support portion 85 is formed as being protruded toward the platen support member 72, the distance between the bracket 50A and the platen support member 72 is not widened. Space saving can be also achieved from a viewpoint of the above.

When the platen roller 45 is pressure-contacted to the thermal head 40, each spring member 99 connected to each platen support member 72 acts so that the pressure-contact force in the width direction of the transfer film 46 is to be evened. Thus, skew occurrence can be prevented while the transfer film 46 is conveyed by the film conveying roller 49. Accordingly, thermal transfer due to the thermal head 40 can be accurately performed without deviation of a print area of the transfer film 46 in the width direction.

A pair of peeling roller support members 88 which support both ends of the peeling roller 34 are arranged at the base plate 87 of the bracket 50A via spring members 97. When the bracket 50A advances to the thermal head 40 with rotation of the cam 53A of the bracket 50A, the peeling roller 34 separates the transfer film 46 and the ink ribbon 41 nipped by the peeling roller 34 and the pinch roller 35 as contacting to the pinch roller 35. Similarly to the platen support members 72, peeling roller support members 88 are arranged at both ends of the peeling roller 34 and is configured so that the pressure-contact force to the pinch roller 35 becomes even in the width direction.

A tension receiving member 52A is arranged at an end part of the bracket 50A opposite to an end part of the shaft 71 side. The tension receiving member 52A is arranged to absorb a tensile force of the transfer film 46 which is generated when the platen roller 45 and the peeling roller 34 are pressure-contacted to the thermal head 40 and the pinch roller 35, respectively. The spring member 99 and the spring member 97 are arranged to even the pressure-contact force of the transfer film 46 in the width direction. Here, the tension receiving member 52A receives the tensile force of the transfer film 46 to prevent the pressure-contact force of the spring members 99, 97 from being weakened by the tensile force of the transfer film 46. Since the tension receiving member 52A is also fixed to the bracket 50A similarly to the tension receiving member 52 described above, the tension force of the transfer film 46 is received by the cam 53A via the bracket 50A without being beaten by the tensile force of the transfer film 46. According to the above, since the pressure-contact force between the thermal head 40 and the platen roller 45 and the pressure-contact force between the pinch roller 35 and the peeling roller 34 are maintained, excellent printing and peeling can be performed. In addition, accurate printing can be performed while the transfer film 46 is accurately conveyed to the thermal head 40 by the amount of the length of the print area without having an error of a conveyance amount of the transfer film 46 during the operation of the film conveying roller 49.

Here, the tension receiving member 52A are configured to receive the tensile force of the transfer film 46 within a range where the abovementioned peeling performance of the pair of peeling members 34, 35 is not lost. As described later in detail, in the present invention, owing to that a conveyance direction and a proceeding direction of the transfer film 46 at the peeping part are differentiated, the peeling angle between the ink ribbon 41 and the transfer film 46 are enlarged and peeling performance thereof is improved. Here, the tension receiving member 52A is arranged at a position where the peeling angle is reduced. Therefore, the tension receiving member 52A is arranged at a position where reduction of the peeling angle is minimized while sufficiently absorbing the tension force of the transfer film 46. According to the above, weakening of the pressure-contact force between the thermal head 40 and the platen roller 45 and the pressure-contact force between the pinch roller 35 and the peeling roller 34 caused by the tension force of the transfer film 46 can be prevented while sufficiently maintaining the peeling angle at the peeling members 34, 35.

The cam 53 and the cam 53A are driven by a common drive motor 54 (illustrated in FIG. 9) while a belt 98 (see FIG. 2) are tensionally routed therearound.

[Peeling Between Transfer Film and Ink Ribbon]

In the following, description will be performed on a structure for performing peeling between the transfer film and the ink ribbon as well as the printing operation. FIG. 5 illustrates a state of a home position (a standby position). When the image forming section B is located at the standby position illustrated in FIG. 5, the cam 53 and the cam 53A are in the state illustrated in FIG. 2. Here, the pinch rollers 32*a*, 32*b* are not pressure-contacted to the film conveying roller 49 and the platen roller 45 is not pressure-contacted to the thermal head 40. When printing is instructed, the feeding roll 48 winds the transfer film 46 as rotating in the counterclockwise direction. The winding is performed until a positioning mark 46*a* set at the transfer film 46 arrives at a position being the feeding roll 48 side from a sensor Se3.

When the cam 53 and the cam 53A becomes into a state illustrated in FIG. 3 as being interlocked and rotated, the image forming section B is shifted into the print position as illustrated in FIG. 6. At that time, first, the pinch roller 32*a*, 32*b* causes the transfer film 46 to be wound to the film conveying roller 49 and the tension receiving member 52 is contacted to the transfer film 46. Subsequently, the platen roller 45 is pressure-contacted to the thermal head 40. At the print position, the platen roller 45 is moved toward the thermal head 40 and provides pressure-contact as sandwiching the transfer film 46 and the ink ribbon 41. Further, the peeling roller 34 is contacted to the pinch roller 35.

In the above state, when the transfer film 46 starts to be conveyed with rotation of the film conveying roller 49, the ink ribbon 41 is concurrently conveyed in the same direction as being wound by the winding roll 44 with the operation of the motor Mr1. During the conveying of the above, printing with the thermal head 40 is performed on a predetermined area of the transfer film 46 at the time when the positioning mark 46*a* set at the transfer film 46 moves by a predetermined amount as passing through the sensor Se3 and the transfer film 46 arrives at a print start position. In particular, the tensile force of the transfer film 46 becomes large during printing. The tensile force of the transfer film 46 acts in a direction to separate the pinch rollers 32*a*, 32*b* from the film conveying roller 49 and a direction to separate the peeling roller 34 and the platen roller 45 respectively from the pinch roller 35 and the thermal head 40. However, as described above, the tension force of the transfer film 46 is received by the tension receiving members 52, 52A. Therefore, accurate film conveyance can be performed without weakening of the pressure-contact force of the pinch rollers 32*a*, 32*b*. Further, since weakening of the pressure-contact force between the thermal head 40 and the platen roller 45 and the pressure-contact force between the pinch roller 35 and the peeling roller 34 is prevented, accurate printing and peeling can be performed. The ink ribbon 41 after the printing is peeled from the transfer film 46 and wound to the winding roll 44.

Here, printing is not started concurrently when being at the print position. A characteristic point of the above is that the transfer film 46 is nipped owing to advancing of the platen roller 45 toward the thermal head 40, and then, printing is started after the ink ribbon 41 and the transfer film 46 are moved to the print start position in a state of being overlapped. According to the above, contacting between the ink ribbon 41 and the transfer film 46 is ensured and printing accuracy is improved.

Meanwhile, after the printing with the thermal head 40 is finished, the ink ribbon 41 is to be wound by the winding roll 44 and the transfer film 46 is to be wound by the film conveying roller 49 while the transfer film 46 and the ink ribbon 41 are nipped by the peeling roller 34 and the pinch roller 35. Thus, both of the above are peeled. With respect to a line connecting the pair of peeling members 34, 35 and the guide roller for conveying the ink ribbon 41 and the transfer film to the print position in an overlapped state, the pressure-contact point between the platen roller 45 and the thermal head 40 is arranged at a position being offset by a predetermined amount to the outside of the film cassette 100 and the pressure-contact points between the film conveying roller 49 and the pinch rollers 32*a*, 32*b* are offset by a predetermined amount to the inside of the film cassette 100. Accordingly, the transfer film 46 and the ink ribbon 41 can be separated at a large angle and peeling can be reliably performed.

The movement amount of conveying the transfer film 46, that is, a length of the print area on which printing is performed in the conveyance direction, is detected by a sensor (not illustrated) arranged at the film conveying roller 49. In accordance with the above, rotation of the film conveying roller 49 is stopped and winding with the winding roll 44 due to the operation of the motor Mr2 is stopped at the same time. Thus, printing in the first color onto the print area of the transfer film 46 due to the thermal head 40 is completed.

Figure 7:
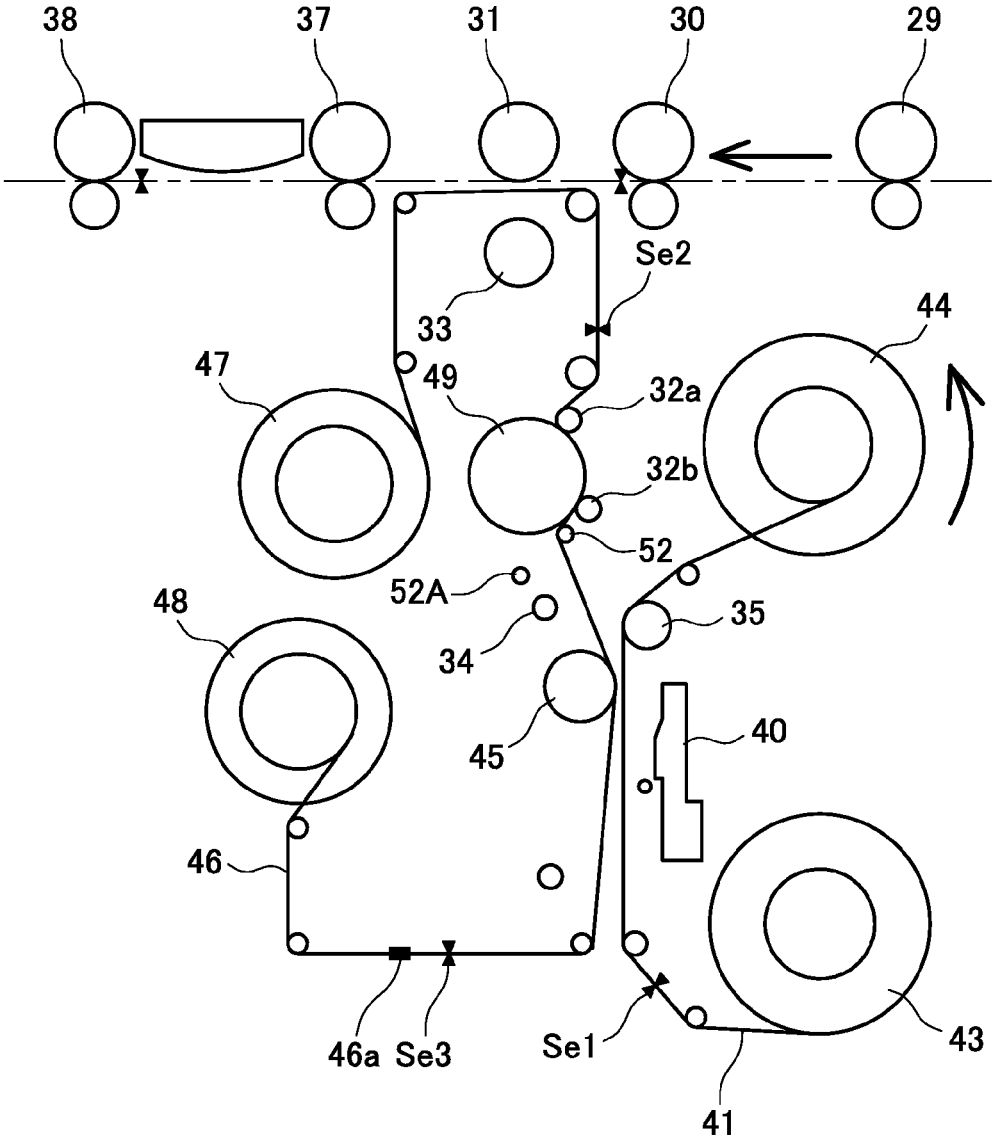
FIG. 7 is an explanatory operational view illustrating a state of the print position of the printer.

When the cam 53 and the cam 53A becomes into a state of FIG. 4 as being interlocked and rotated further, the image forming section B is shifted to the conveyance position as illustrated in FIG. 7 and the platen roller 45 is returned in a direction of retreating from the thermal head 40. In this state, the pinch rollers 32*a*, 32*b* remain winding the transfer film 46 to the film conveying roller 49 and the tension receiving member 52 remains contacted to the transfer film 46, and then, the transfer film 46 is reversely conveyed to the initial position with reverse rotation of the film conveying roller 49. The movement amount of the transfer film 46 at that time is also controlled by rotation of the film conveying roller 49. The reverse conveying is performed by an amount of the length of the print area where printing has performed in the conveyance direction. Here, the ink ribbon 41 is stopped and has a panel of a color to be printed subsequently set in a standby state at the initial position.

Then, the control state due to the cams 53, 53A is returned to the state illustrated in FIG. 3 to be at the print position as illustrated in FIG. 6. Here, the platen roller 45 is pressure-contacted to the thermal head 40 and the transfer film 46 is moved by the amount of the length of the print area while the film conveying roller 49 is forwardly rotated again. Then, printing is performed with the thermal head 40 in the next color.

In this manner, operations at the print position and the conveyance position are repeated until printing is completed in all colors. When printing (primary transferring) with the thermal head 40 is completed, the primarily-transferred area of the transfer film 46 is conveyed to the heat roller 33. At that time, the cams 53, 53A are moved into a state illustrated in FIG. 2, so that pressure-contact to the transfer film 46 is released. As the subsequent secondary transferring, transferring onto a card is performed while conveying the transfer film 46 with driving of the winding roll 47.

That is, a leading end of the image formed on the transfer film 46 is set at a transfer start position above the heat roller 33 through detection due to the sensor Se2. A leading end of a card is also set at the transfer start position, and then, the heat roller 33 is lifted. Transferring is performed with heating while the transfer film 46 and the card are nipped by the heat roller 33 and the platen roller 30. At that time, the transfer film 46 is wound by the winding roll 47 and the card is conveyed with rotation of the heat roller 33.

[Unitization of Primary Transfer Portion]

The primary transfer portion of the above-mentioned structure is integrated as being separated into three units 91, 92, 93. In the following, description will be performed in detail on the three units 91, 92, 93 which structure the primary transfer portion.

In general, a printer which performs transferring onto a transfer film with an ink ribbon as disclosed in Patent Literature 1 requires frequent replacement of cassettes which contains the transfer film and the ink ribbon respectively when consumed. Here, care is required to be taken when an operation to detach and attach a cassette is performed for managing interference of the transfer film and the ink ribbon with each member such as a conveying mechanism and a thermal transfer mechanism. In particular, if the transfer film or the ink ribbon is routed to these members at incorrect positions when attaching the cassette, printing cannot be performed.

Meanwhile, if arrangement among the respective members which structure a thermal transfer mechanism and a conveying mechanism of the transfer film and the ink ribbon is not performed with accurate positioning, there arises a problem that print quality is decreased with occurrence of print deviations. It has been requiring a great amount of time for assembling these members in adjustment during manufacturing or maintenance.

From a viewpoint of the above, the present embodiment provides an appropriate unitization structure for integrating the respective members of the primary transfer portion in the printer to be separated into a plurality of units.

In a first unit 91 illustrated in FIG. 8, a drive shaft 70 which is rotated with driving of the motor 54 (illustrated in FIG. 9) is mounted on a unit frame body 75 and the film conveying roller 49 is attached to the drive shaft 70. The bracket 50A and a pair of the platen support members 72 are arranged below the film conveying roller 49 as being rotatably supported by the shaft 71 which is bridged to both side plates of the unit frame body 75.

In FIG. 8, a pair of the cam receiver support portions 85 being a part of the bracket 50A appear through the hole portions 72*a*, 72*b* which are formed at the platen support member 72. The cam receiver support portions 85 hold a pair of the cam receivers 84 which are arranged at the back side thereof. Then, the cam 53A attached to the cam shaft 83 penetrating the unit frame body 75 is arranged at the further back side of the cam receiver 84. The cam shaft 83 is bridges to both side plates of the unit frame body 75.

Figure 10:
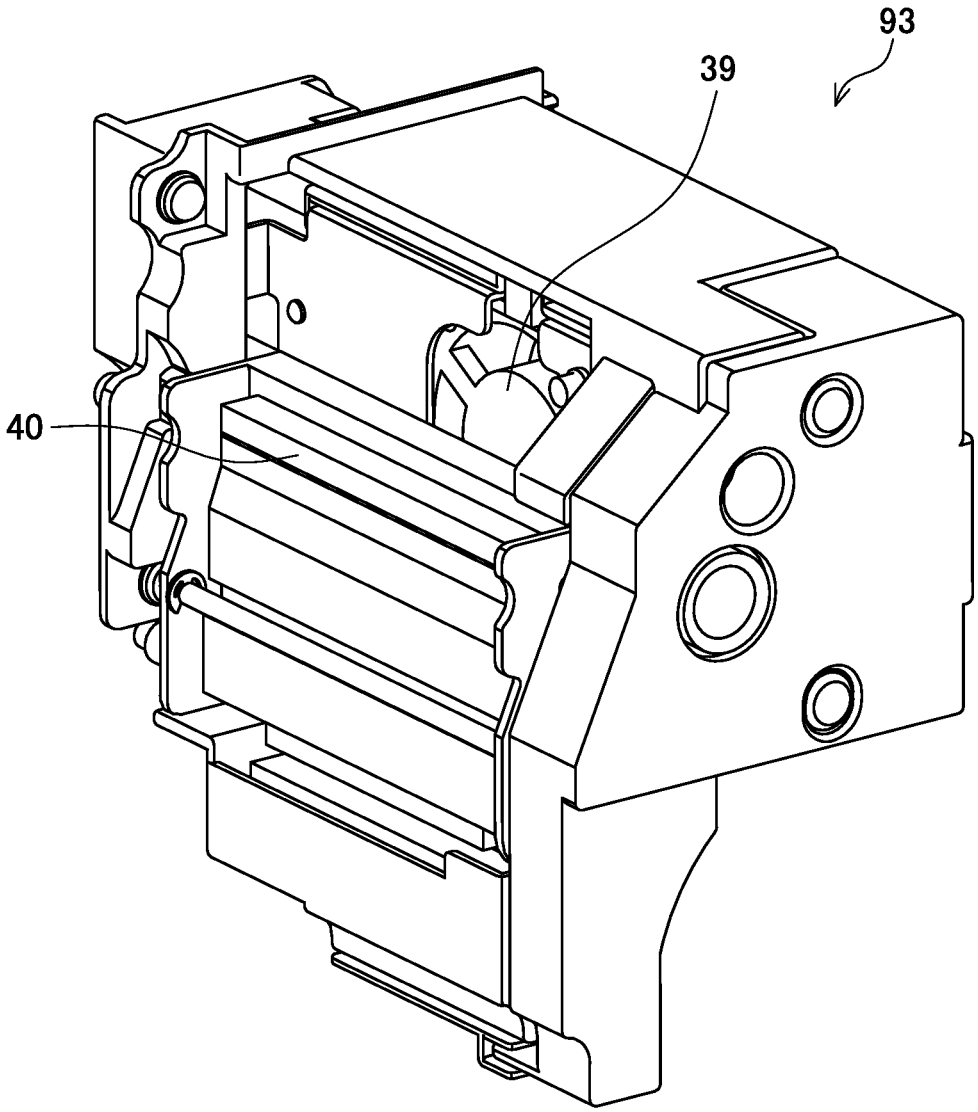
FIG. 10 is an external view of a third unit integrating the thermal head for assembling into the printer.

The thermal head 40 is arranged at a position being faced to the platen roller 45 as sandwiching the conveyance passage of the transfer film 46 and the ink ribbon 41. The thermal head 40, members related to heating, and the cooling fan 39 are integrated into a third unit 93 as illustrated in FIG. 10 and are arranged as being faced to the first unit 91.

In the first unit 91, the movable bracket 50A collectively holds the platen roller 45, the peeling roller 34, and the tension receiving member 52A which are moved in accordance with print operations, so that positional adjustment among the members is not required. Further, the members can be moved to predetermined positions by moving the bracket 50A with rotation of the cam 53. Further, owing to that the bracket 50A is arranged, the members can be stored into the same unit as the fixedly-arranged film conveying roller 49. Since a conveyance drive section with the film conveying roller 49 which is required to accurately convey the transfer film and a transfer position restricting section with the platen roller 45 are included in the same unit, positional adjustment therebetween can be skipped.

In the second unit 92 illustrated in FIG. 9, the camshaft 82 to which the cam 53 is attached is inserted to a unit frame body 55 and is coupled with an output shaft of the drive motor 54. Further, in the second unit 92, the bracket 50 is movably supported by the unit frame body 55 so as to be contacted to the cam 53. The tension receiving member 52 and the support shaft 58 which rotatably supports the pinch roller support member 57 are fixedly arranged at the bracket 50.

The spring members 51*a*, 51*b* are attached to the support shaft 58, and then, both end parts thereof are contacted to the end parts of the pinch roller support member 57 which supports the pinch rollers 32*a*, 32*b* to urge toward the film conveying roller 49. Further, in the pinch roller support member 57, the support shaft 58 is inserted to the elongated holes 76, 77 and the support shaft 58 is fixed at the middle part thereof to the bracket 50.

A spring 89 which urges the pinch roller support member 57 toward the bracket 50 is arranged between the bracket 50 and the pinch roller support member 57. Since the pinch roller support member 57 is urged by the spring 89 in a direction of retreating from the film conveying roller 49 in the first unit 91, the transfer film 46 can be easily routed between the first unit 91 and the second unit 92 when the film cassette 100 is attached to the printer 1.

In the second unit 92, the bracket 50A holds the pinch rollers 32*a*, 32*b* and the tension receiving member 52 which are moved in accordance with print operations. Here, the pinch rollers 32*a*, 32*b* and the tension receiving member 52 are moved by moving the bracket 50A with rotation of the cam 53. Accordingly, it is possible to simplify positional adjustment between both thereof and positional adjustment between the film conveying roller 49 and the pinch rollers 32*a*, 32*b*. The second unit 92 is arranged as being faced to the first unit 91 while sandwiching the transfer film 46.

According to unitization described above, the first unit 91, the second unit 92, and the third unit 93 can be pulled out respectively from a main body of the printer 1 as being similar to the respective cassettes of the transfer film 46 and the ink ribbon 41. Accordingly, if some of the units 91, 92, 93 are also pulled out as required at the time of cassette replacement due to consumption of the transfer film 46 or the ink ribbon 41, the transfer film 46 and the ink ribbon 41 can be easily routed at the time of cassette insertion.

As described above, owing to that the first unit 91 in which the platen roller 45, the bracket 50A, the cam 53A, and the platen support member 72 are integrated and the second unit 92 in which the pinch rollers 32*a*, 32*b*, the bracket 50, the cam 53, and the spring member 51 are integrated are combined and the third unit 93 to which the thermal head 40 is attached is assembled as being faced to the platen roller 45, assembling for manufacturing a printer and adjusting for maintenance can be performed easily and accurately.

In particular, it is possible that the fixedly-arranged film conveying roller 49 which is required to accurately convey the transfer film and the platen roller 45 which defines a transfer position by being moved to press the transfer film 46 are configured to be integrated into the common unit. Owing to the integration, positional adjustment between the conveying and driving section and the transferring section becomes unnecessary.

Further, since another unit can be structured with reference to the above unit, adjustment for manufacturing and maintenance can be facilitated. In addition, positional accuracy of members arranged in and between the units is improved.

Further, according to the integration into the units, positions where the transfer film and the ink ribbon are to be arranged can be easily recognized when replacing the transfer film and the ink ribbon and detaching thereof from the printer can be easily performed. Thus, a printer having excellent handleability is provided.

Further, as described above, owing to that the tension receiving member 52 prevents occurrence of looseness (release of pressure-contact) between the film conveying roller 49 and the pinch rollers 32*a*, 32*b* and that the tension receiving member 52A prevents occurrence of looseness (release of pressure-contact) between the platen roller 45 and the thermal head 40 and occurrence of looseness (release of pressure-contact) between the punch roller 35 and the peeling roller (peeling koro) 34, accurate conveying can be performed without being influenced by a tensile force of the transfer film 46 and printing can be accurately performed.

Normally, the ink ribbon 41 is cyclically applied with ink of respective colors as ink of three or four colors being one frame. Therefore, the transfer film 46 is required to be moved in a reciprocating manner for forming an image on the transfer film 46. If the transfer film 46 is not conveyed to an accurate position at appropriate posture, there arises a problem that print quality is decreased with occurrence of deviation of ink transfer positions. However, according to the abovementioned structure, conveying can be performed while the nipping pressure-contact force to the transfer film 46 is continuously evened, so that print quality of the printer can be improved.

In the above, description is performed on a device in a printer to convey a transfer film. However, it is applicable to any device which performs conveying while nipping a film-shaped medium with a pressure-contacting member and a pressure-contacted member.

[Guide Shaft Mechanism]

Next, a guide shaft mechanism for correcting skew of a film during conveyance will be described. For example, according to Patent Literature 2, in a printer which performs thermal transfer from an ink ribbon to a card surface, a guide shaft has a function as a peeling roller which peels an ink ribbon from a medium after printing. The guide shaft has an outer circumferential face covered with a friction member and elastically urged by an elastic member to be movable in the width direction of the ink ribbon. When skew occurs at the ink ribbon, the guide shaft is elastically moved in accordance with the skew of the ink ribbon and correction thereof is performed as returning the skewed ink ribbon to the center.

In general, the guide shaft is required to be continuously perpendicular to a feeding direction of a film. Here, for smooth rotation in the same direction along with winding motion of the film, the guide shaft is inserted to a supporting hole of a housing with play.

Therefore, according to the related art, when the guide shaft is in an inclined state as being deviated from the center of the film feeding direction due to film skew, the inclined posture is not resolved and the skew is not corrected even if being returned with urging of the urging member.

Here, a guide shaft according to the present embodiment enables to correct skew even if being deviated from a film feeding direction in a film conveying apparatus for conveying a transfer film and an ink ribbon.

Figure 11:
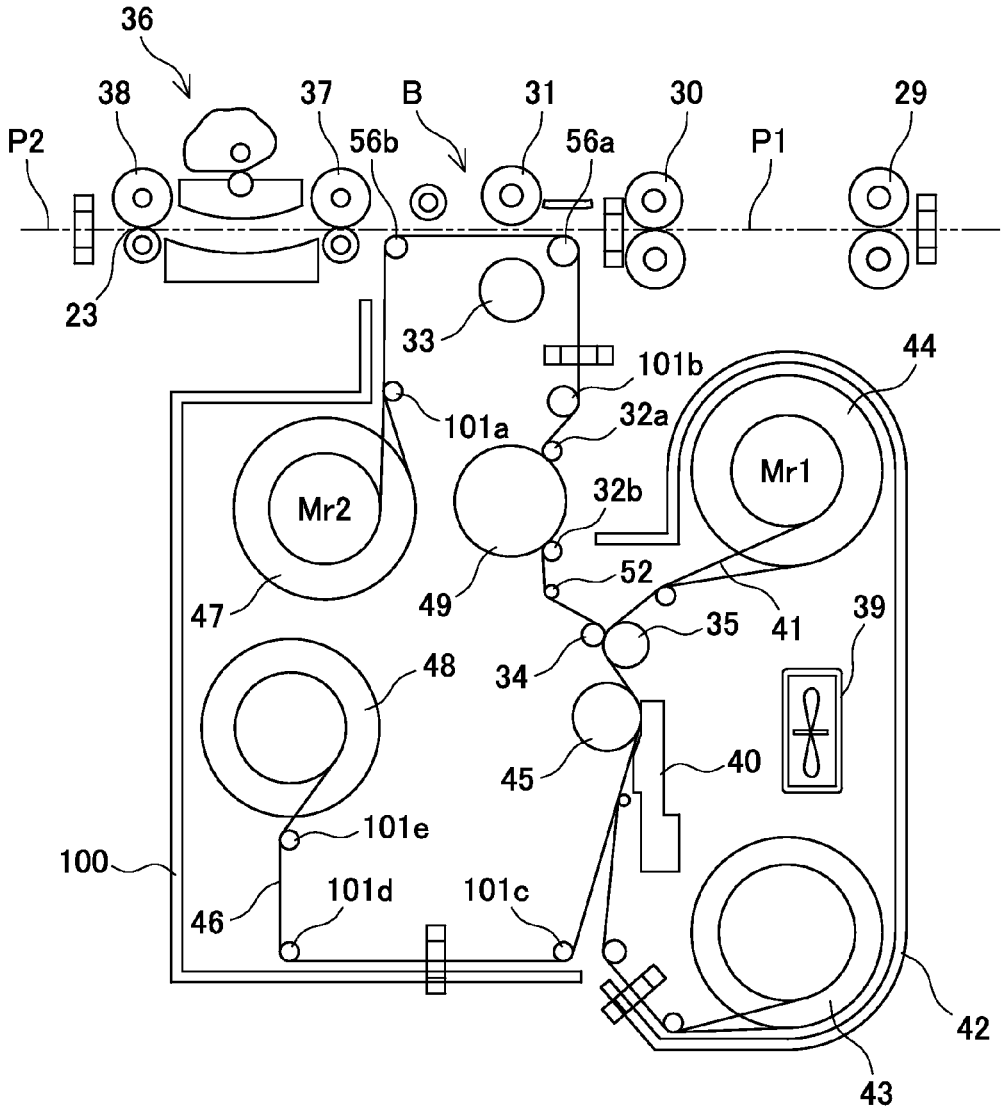
FIG. 11 is an enlarged view of a main part of the printer illustrated in FIG. 1.

FIG. 11 is an enlarged view of a main part of the printer 1 illustrated in FIG. 1 as enlarging the image forming section B. As illustrated in FIG. 11, the transfer film 46 between the winding roll 47 and the feeding roll 48 is conveyed as being routed to the film conveying roller 49, guide shafts 101, a guide roller 56*a*, a peeling roller 56*b*, and the like. The film cassette 100 is structured with a cassette housing containing the plurality of guide shafts 101*a* to 101*e*, the guide roller 56*a*, the peeling roller 56*b*, and later-mentioned side walls 102A, 102B and holds the winding roll 47 and the feeding roll 48 to which the transfer film 46 is wound. Here, the film cassette 100 is arranged to be attachable to and detachable from the printer. When replacing a used transfer film 46, the transfer film 46 is replaced after the film cassette 100 is removed from the printer.

As described above, the ink ribbon 41 is stored in the cartridge 42 and the cartridge 42 contains the feeding roll 43 and the winding roll 44. The ink ribbon 41 is wound to the wind roll 44 with driving of the motor Mr1. Similarly to the film cassette 100, the cartridge 42 is configured to be attachable to and detachable from the printer so that a used ink ribbon 41 is replaceable.

The guide roller 56*a* arranged at the secondary transfer portion guides the transfer film 46 to the platen roller 31 and the peeling roller 56*b* peels the transfer film 46 after transferring from a card. That is, the peeling roller 56*b* is rotated with winding operation of the winding roll 47 due to motor Mr2 and peels the transfer film 46 from the card approximately in perpendicular to the medium conveyance passage P2.

In the present embodiment, a guide shaft mechanism which performs guiding while correcting skew of a film to be conveyed is adopted as each guide shaft arranged at an appropriate position of each film conveyance passage in the conveying device of the transfer film 46 and the conveying device of the ink ribbon 41. Here, an example of a guide shaft 101*a* of the conveying device of the transfer film 46 will be described in the following.

The guide shaft 101*a* is arranged at a position where the transfer film 46 after printing is peeled from a card by the peeling roller 56*b* and conveyed and wound to the winding roll 47. To improve slip of the transfer film 46, a surface of the guide shaft 101*a* is coated with a fluorine resin base material or a silicone base material. It is also possible to ensure necessary slip characteristics by polishing the surface of the guide shaft 101*a* made of stainless steel.

Figure 12:
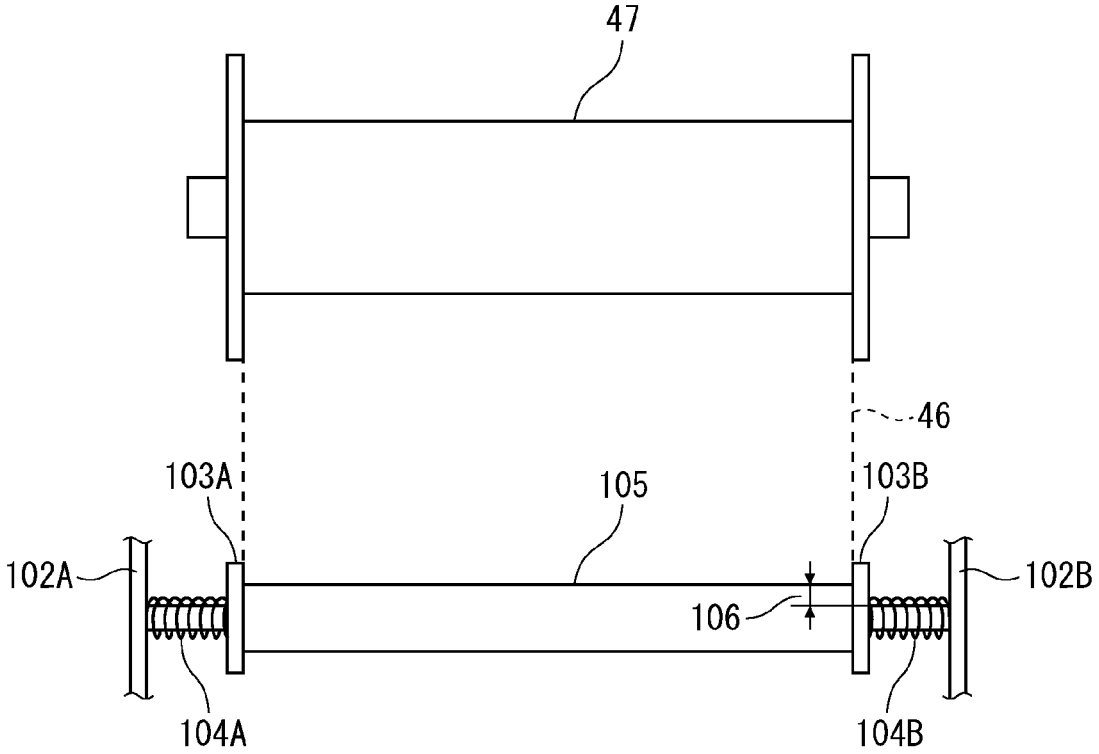
FIG. 12 is an explanatory view illustrating an embodiment of a guide shaft mechanism.
Figure 13:
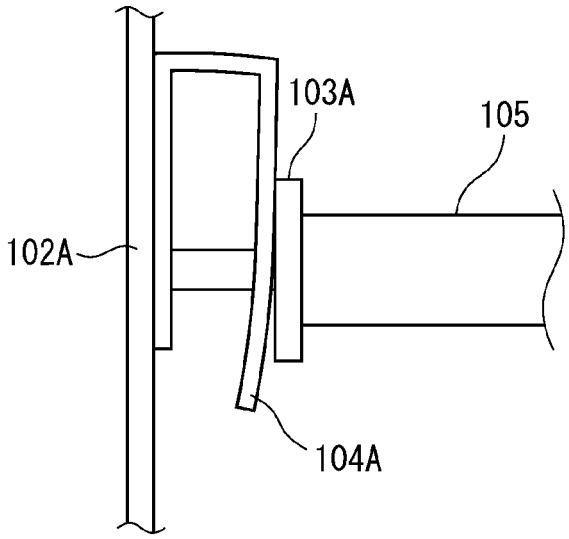
FIG. 13 is an explanatory view illustrating another embodiment of the guide shaft mechanism.

As illustrated in FIG. 12, the guide shaft 101*a* is bridged to side walls 102A, 102B (a housing of the film cassette 100) which form the conveyance passage of the transfer film 46 in the printer 1. Flanges 103A, 103B are fitted to both ends of the guide shaft 101*a*. Further, urging members 104A, 104B are arranged respectively between the side wall 102A and the flange 103A and between the side wall 102B and the flange 103B. The urging members 104A, 104B are springs attached as being inserted to the guide shaft 101*a*. As illustrated in FIG. 13, it is also possible to adopt a plate spring with one end contacted to the side wall 102A, 102B and the other end contacted to the flange 103A, 103B.

The flanges 103A, 103B are moved along the guide shaft 101*a* penetrating a center part as being urged by the urging members 104A, 104B respectively. Here, a diameter of the guide shaft 101*a* for defining a film contacting member 105 which is contacted to the transfer film 46 is set larger than diameters of other portions. Owing to a step 106 being a restricting portion, the flanges 103A, 103B are restricted not to be moved inward from a width of the transfer film 46 which is to be guided by the guide shaft 101.

Urging forces of the urging members 104A, 104B are set to be smaller than an elastic force of the transfer film 46 in a tightening state and larger than an elastic force of the transfer film 46 in a loosening state. Owing to the urging forces set as described above, the elastic force of the tightening transfer film 46 overcomes the urging force of the urging member 104A, 104B, and the transfer film 46 is prevented from being bent at an area of the flange 103. In the present embodiment, the urging force (spring pressure) of each urging member 104 is set to 5 gram. However, it is possible to be appropriately set in accordance with the elastic force of the transfer film 46.

Loosening of the transfer film 46 occurs at a moment when the heat roller 33 and the platen roller 31 are separated. The transfer film 46 held with pressure-contact between the heat roller 33 and the platen roller 31 is to be in a deflecting and loosening state at a moment when the pressure-contact is abruptly released. Subsequently, the transfer film 46 returns into a tightening state as being conveyed by the conveying mechanism. Here, if skew occurs at the moment of loosening, the transfer film 46 is kept in a skewed state. Consequently, at printing onto the next card, there arises a problem that positional deviation occurs between an ink-applied portion of the transfer film 46 and the card surface.

Such skew occurs especially when the transfer film 46 is peeled from a card such that peeling at one end requires long time with uneven peeling due to uneven ink density corresponding to image data in the width direction of the transfer film 46.

Once skew occurs, winding is performed at the winding roll 47 in a state that the rotation shaft is not appropriately faced to the width direction of the transfer film 46. Then, the error is amplified at each time of winding to be in a state that winding cannot be performed, so that jamming occurs to end up with print stopping.

When the transfer film 46 is skewed with loosening as described above, an end part of the film at the deviated side in the longitudinal direction is to be moved outward as abutting to either of the flanges 103A, 103B facing thereto. However, the movement is blocked by the urging force of the urging members 104A, 104B corresponding to the flanges 103A, 103B. Thus, when loosening occurs at the transfer film 46, restriction is applied directly to an end part of the transfer film 46 in the longitudinal direction and skew is corrected. Consequently, the transfer film 46 is wound to the winding roll 47 at appropriate posture.

Although skew does not occur during the transfer film 46 is conveyed in a tightening state, there may be a case that an end part of the transfer film 46 in the longitudinal direction is abutted to the flanges 103A, 103B during conveyance. Since the urging members 104A, 104B retreat outward in such a case, conveyance of the transfer film 46 is not disturbed.

Hole portions larger than the diameter of the guide shaft 101 are formed at the side walls 102A, 102B where the guide shaft 101 is bridged. The guide shaft 101 is rotatably supported having both end parts inserted to the hole portions. When unevenness occurs at both ends as a result of weight imbalance of the winding roll 47, wrinkles of the transfer film 46 in the width direction, or the like, there may be a case that the guide shaft 101 is not perpendicular to the proceeding direction of the transfer film 46. Such deviation of the guide shaft 101 may cause skew. However, owing to correcting by the urging members 104A, 104B, winding is performed appropriately at the winding roll 47.

As described above, the guide shaft mechanism in a film conveying device according to the present invention performs guiding while correcting skew of the transfer film 46 to be conveyed. Not limited to a case after peeling from a card, it is possible to be adopted to any guide shaft arranged on the conveyance passage of the transfer film 46. Further, it is also possible to be applied to a guide shaft arranged on the conveyance passage of the ink ribbon 41. In the present embodiment, the guide shaft 101*a* is arranged at the film cassette 100 as an example. However, not limited to the film cassette 100, it is possible to be applied to a shaft arranged in a main body of the printer 1 which forms a conveyance passage of the transfer film 46.

Figure 14:
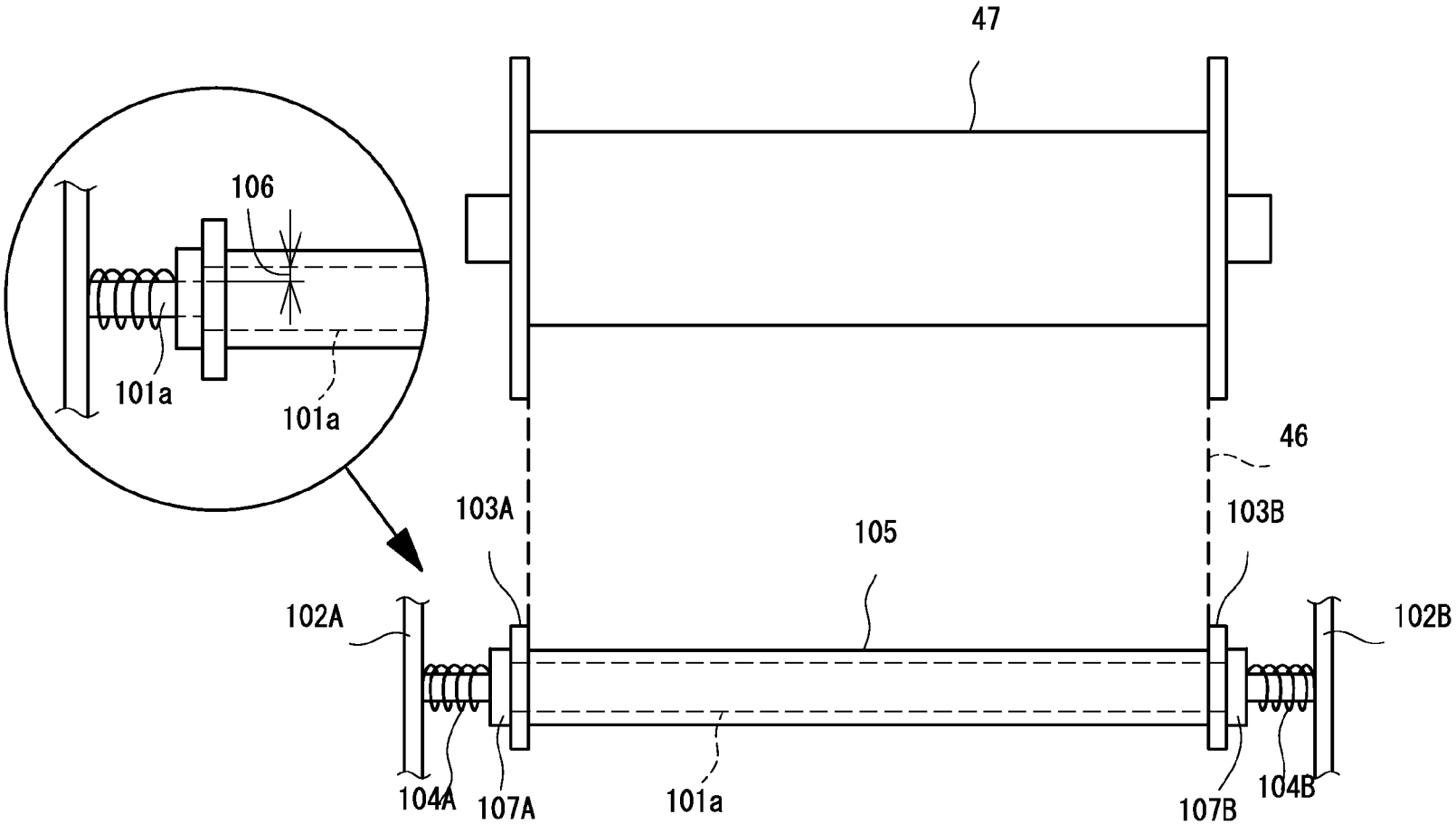
FIG. 14 is an explanatory view illustrating another embodiment of the guide shaft mechanism.

Here, the guide shaft 101*a* may have a structure illustrated in FIG. 14. In this structure, the flanges 103A, 103B and the film contacting member 105 are arranged to be movable in the axis direction of the guide shaft 101*a* as being integrated around the guide shaft 101*a*. The guide shaft 101*a* is configured to have a small diameter at both ends and a large diameter at the center part, so that the steps 106 (restricting portion) are formed.

The urging members 104A, 104B and flange pressing members 107A, 107B which urge and press the flanges 103A, 103B with the urging members 104A, 104B are arranged at both end sides (small-diameter portions) of the guide shaft 101*a*. The guide shaft 101*a* is moved in the axis direction by pressing the flanges 103A, 103B. Here, the movement of the flange pressing members 107A, 107B is restricted by the restricting portion 106. According to the above, the flanges 103A, 103B and the film contacting member 105 can be positioned at positions where the guide shaft 101*a* and the transfer film 46 are orthogonal (being a state in FIG. 14)

Further, the flanges 103A, 103B and the film contacting member 105 are arranged as being rotatable around a circumferential face of the guide shaft 101*a*. Sliding can occur respectively between the flange 103A and the flange pressing member 107A and between the flange 103B and the flange pressing member 107B. In this case, it is not required to improve slip of a circumferential face of the film contacting member 105.

Figure 15:
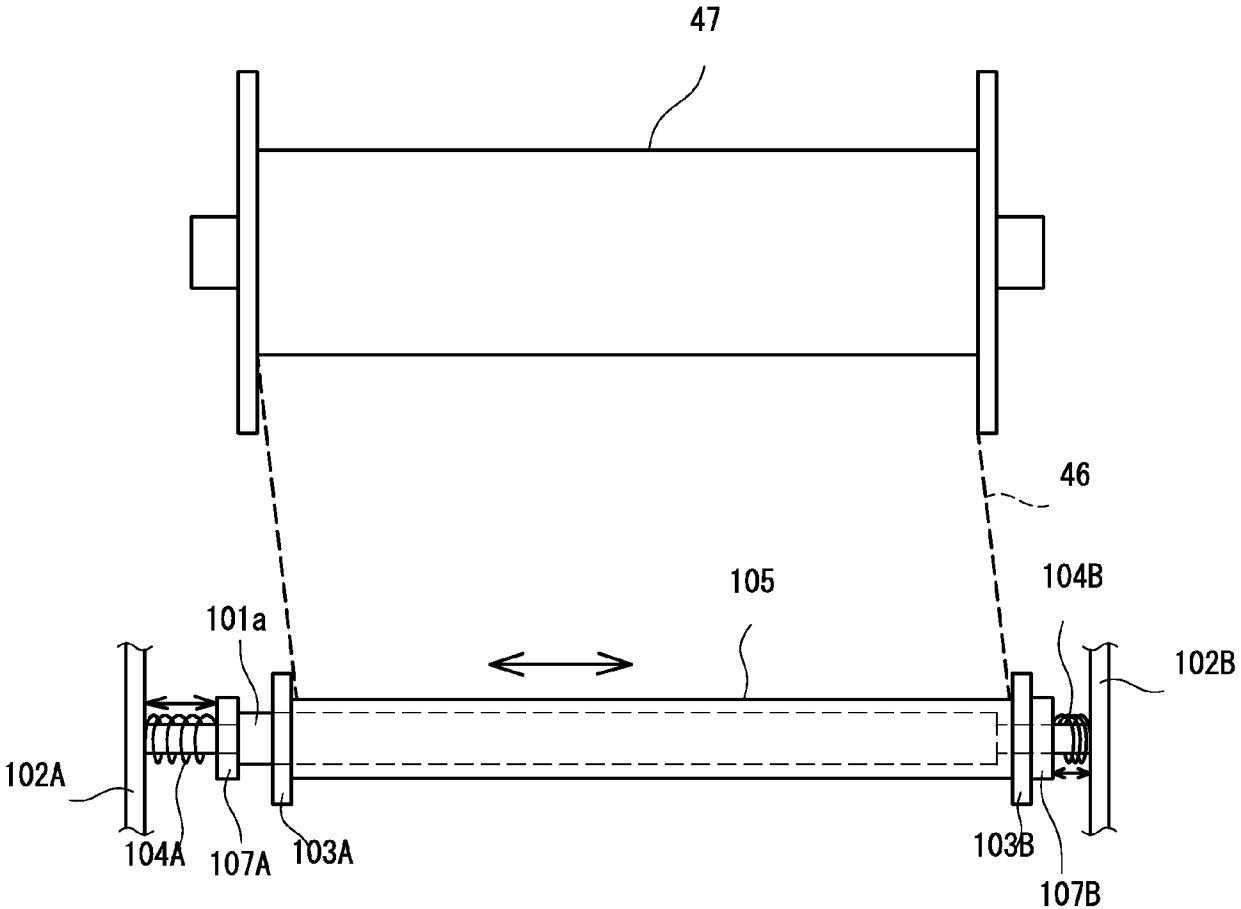
FIG. 15 is an explanatory view illustrating a state that a transfer film is skewed in another embodiment of the guide shaft mechanism.

The urging forces of the urging members 104A, 104B are set to be smaller than the elastic force of the transfer film 46 in a tightening state and larger than the elastic force of the transfer film 46 in a loosening state. Accordingly, although the flanges 103A, 103B and the film contacting member 105 are moved as illustrated in FIG. 15 when the transfer film 46 is in the tightening state, skew of the transfer film 46 is corrected as being returned by the force of the urging member into positions illustrated in FIG. 14 (positions where the guide shaft 101*a* and the transfer film 46 are orthogonal) at a moment when the transfer film 46 loosens. The urging forces of the urging members 104A, 104B are the same as in the embodiment illustrated in FIG. 12.

In the present example, the urging members 104A, 104B are springs. However, it is also possible to integrally form the urging member and the flange pressing member as having a plate spring shape as illustrated in FIG. 13.

As described above, the present embodiment has a structure including a guide shaft bridged to a pair of side walls which form a conveyance passage of a film, a pair of flanges arranged respectively at both end parts of the guide shaft, a film contacting portion which is formed between the pair of flanges and which is contacted in a width direction to the film to be conveyed, an urging member arranged between the side wall and the flange which are mutually faced, and a restricting portion which prevents the flange from advancing toward the film contacting portion. With the above structure, since the film-shaped medium to be conveyed is restricted directly by the flange which is urged by the urging member, the guide shaft can guide the film while performing skew correcting.

[Card Cleaning Mechanism]

Next, a cleaning mechanism for removing dust from a card which is fed from the card cassette 3 will be described. If dust is stuck to a card when recording electronic information or image information on the card, there may be a case that recorded information error or imaging error is caused. Therefore, it is commonly performed to feed a card to a recording portion after dust on a surface of a stored card is removed.

For example, Patent Literature 3 discloses a mechanism in which cleaning of a card is performed by structuring a roller contacting to a card front surface and a roller contacting to a card back surface with cohesive rollers. According to the mechanism, a pair of the cohesive rollers which nips a card and a cleaning roller which performs cleaning of a roller surface as being contacted to one of the rollers are structured as a unit and the cleaning unit is attached to a conveyance passage of a device in a detachably attachable manner.

Further, Patent Literature 4 discloses a mechanism in which a cohesive roller is arranged on a card conveyance passage and dust stuck to a surface of the roller is removed by a cleaning roller. According to Patent Literature 4, the cleaning roller which contacts to the cohesive roller on the conveyance passage is arranged in a ribbon cassette for printing. At the time of attaching the ribbon cassette, the cleaning roller in the cassette is inserted in the axis direction of the cohesive roller in a device.

Here, the cleaning roller is incorporated by the cassette as being movable between a position contacting to the cohesive roller and a position being separated therefrom, and then, a mechanism to perform moving between the contact position and the separation position is arranged in the cassette and is interlocked with cassette attaching operations. Specifically, it is structured that the cleaning roller is interlocked to be at the separation position when an open-close cover (device front cover) for attaching the ribbon cassette is opened and the cleaning roller is interlocked to be at the contact position when closed.

As described above, there have been widely known cleaning mechanisms to remove dust on a card surface before feeding the card to a recording portion. Further, Patent Literature 1 proposes a cleaning mechanism which is attached to a device having a cohesive roller contacting to a card surface and a cleaning roller removing dust stuck on the roller unitized. Further, Patent Literature 2 proposes a cleaning mechanism which removes dust on a cohesive roller arranged in a device with a cleaning roller in a ribbon cassette.

As described above, it has been known to remove dust stuck on a surface of a cohesive roller which contacts to a card with a cleaning roller. In this case, if the mechanism with which the cohesive roller contacting to a card and the cleaning roller are attached to and detached from the device as a unit is adopted as proposed in Patent Literature 3, there arises a problem that a surface of the cohesive roller is damaged when detaching the cleaning unit from the device and replacing the cleaning roller.

On the other hand, according to the mechanism proposed in Patent Literature 4, when a problem occurs at the cohesive roller to contact to a card prepared in the device, for example, when a stuck metal piece cannot be removed by the cleaning roller, it is required for an operator to remove the metal piece stuck on a surface of the roller in the device. In addition, the cleaning roller is required to be replaced at the same time when the ink ribbon is replaced, so that economic loss is produced.

As described above, each time when a problem occurs at the cohesive roller to contact to a card when removing dust stuck on a card surface, replacement or maintenance thereof is required. The cleaning roller is required to be replaced periodically in accordance with a degree of damage. The ink ribbon is required to be replaced in accordance with a consumed amount.

Then, the inventors have come up with an idea of enabling to perform attaching to and detaching from the device separately for each requirement of replacement of the ink ribbon, replacement of the cleaning roller, or maintenance of the cohesive roller to contact to a card. In this case, there newly arises a problem that the cohesive roller and the cleaning roller are required to be unstuck to each other against cohesiveness of the respective surfaces when the rollers are detached from and attached to the device separately and a problem that the device restarts in a state that one of the rollers is not attached when the rollers are detached from and attached to the device separately.

In view of the above, in the present embodiment, replacement and maintenance of a contact roller which removes dust as contacting to a card surface and a cleaning roller which removes dust stuck on a surface of the contact roller can be performed timely in accordance of each condition. Among the whole structure of the printer 1 according to the present invention, description will be performed in the following on a structure in which the contact roller 22 and the cleaning roller Rc are detachably attachable to the device for replacement and maintenance.

Figure 16:
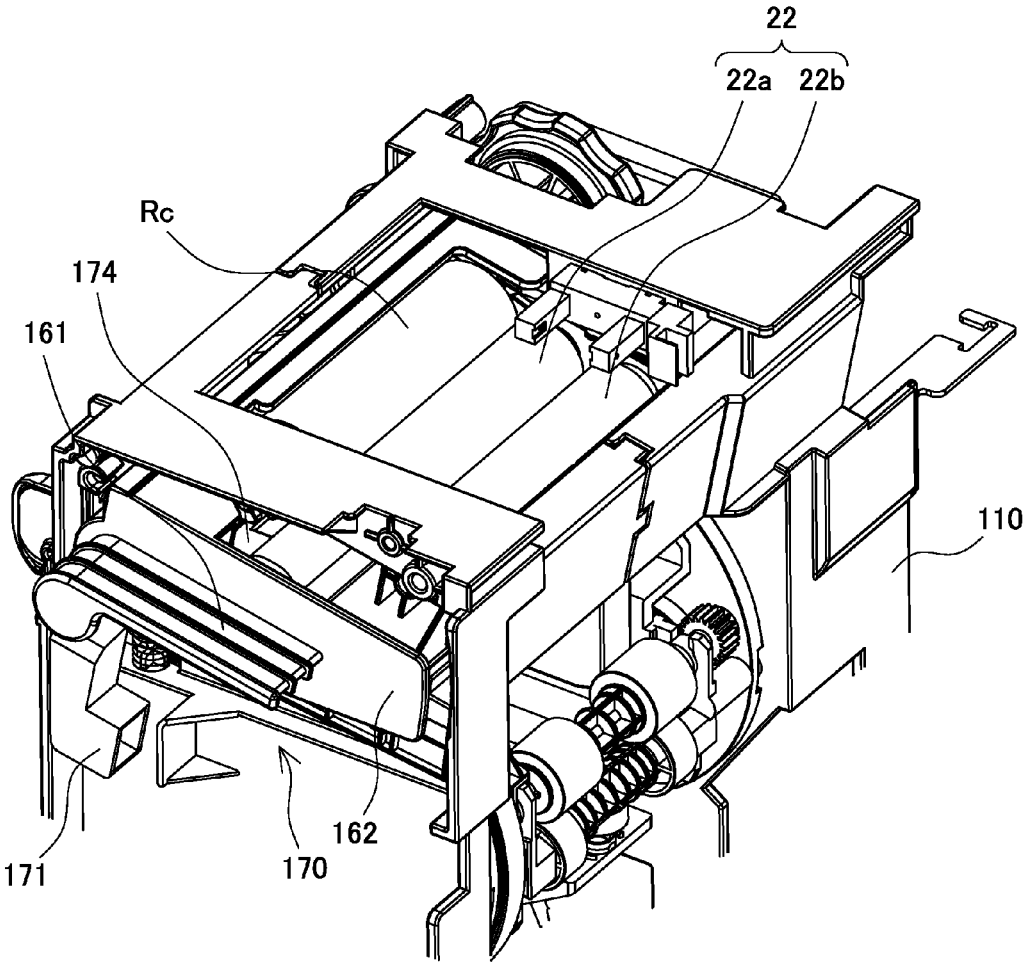
FIG. 16 is an explanatory perspective view illustrating a state that respective rollers of a card cleaning mechanism are attached.
Figure 17:
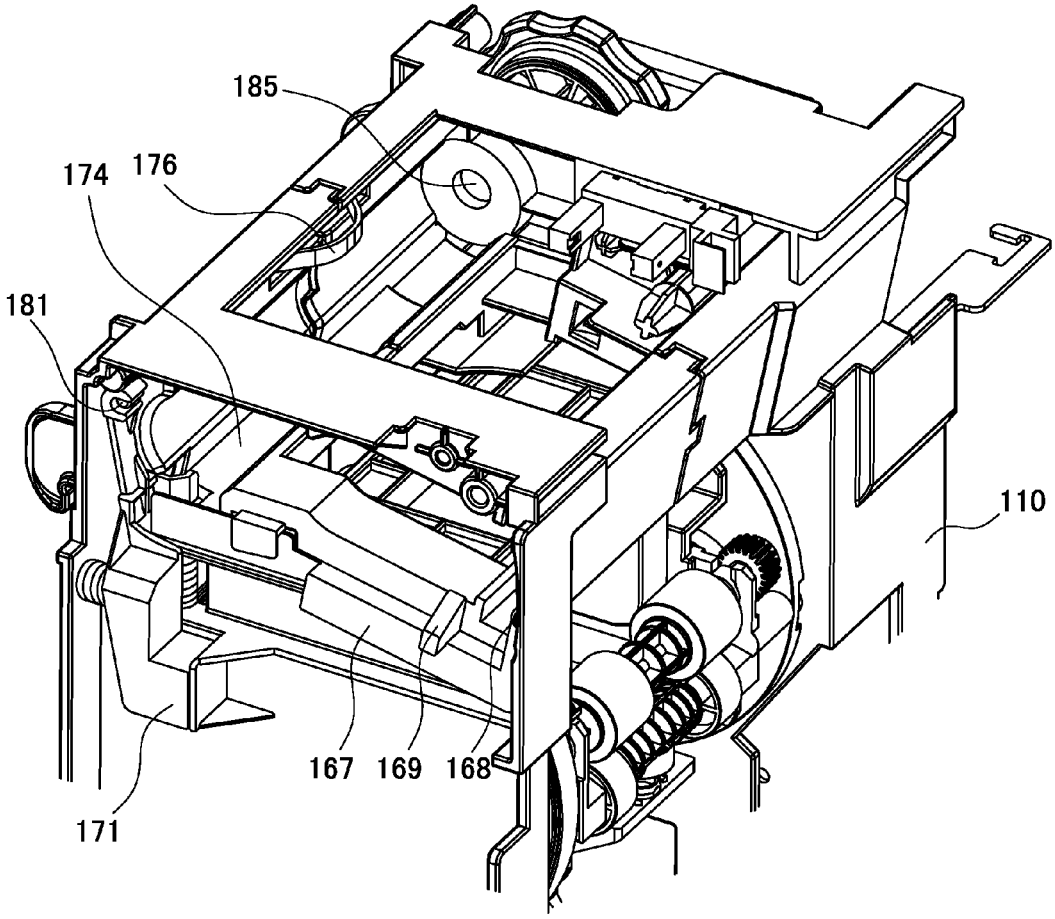
FIG. 17 is an explanatory perspective view illustrating a state that the respective rollers of the card cleaning mechanism are detached.

FIGS. 16 and 17 are perspective views illustrating the contact roller 22 and the cleaning roller Rc of the printer 1 and the periphery thereof. FIG. 16 illustrates a state that the cleaning roller Rc and the contact roller 22 are attached to a device frame 110. FIG. 17 illustrates a state that these rollers are detached from the device frame 110. The device frame 110 forms an attaching opening 174 through which the contact roller 22 and the cleaning roller Rc are detachably attachable separately in the rotation axis direction in a separated state.

Figure 18:
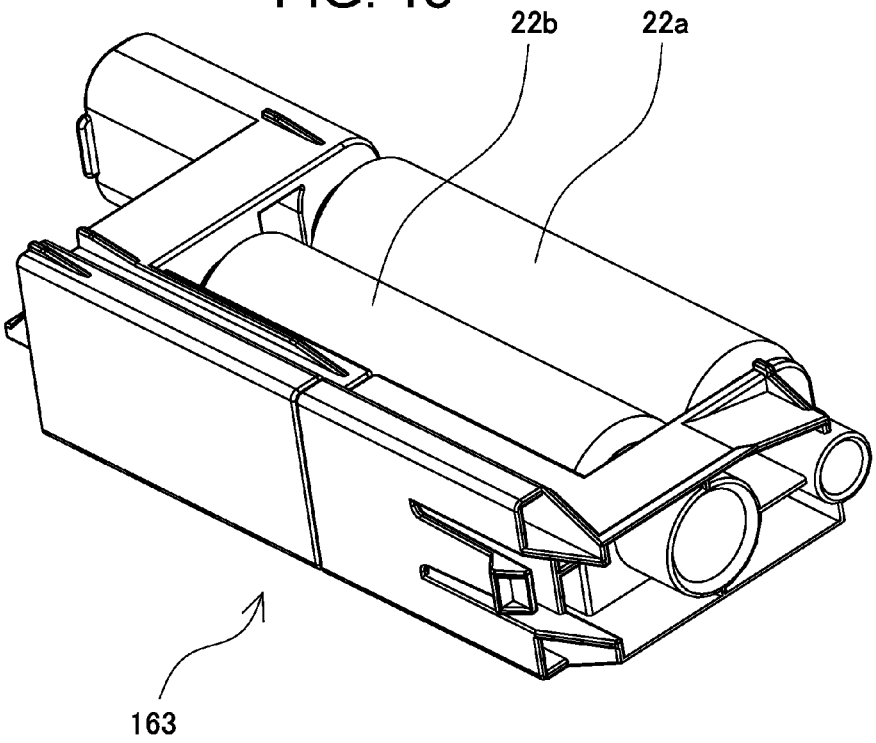
FIG. 18 is an explanatory view illustrating a cartridge storing a contact roller of the card cleaning mechanism.
Figure 19:
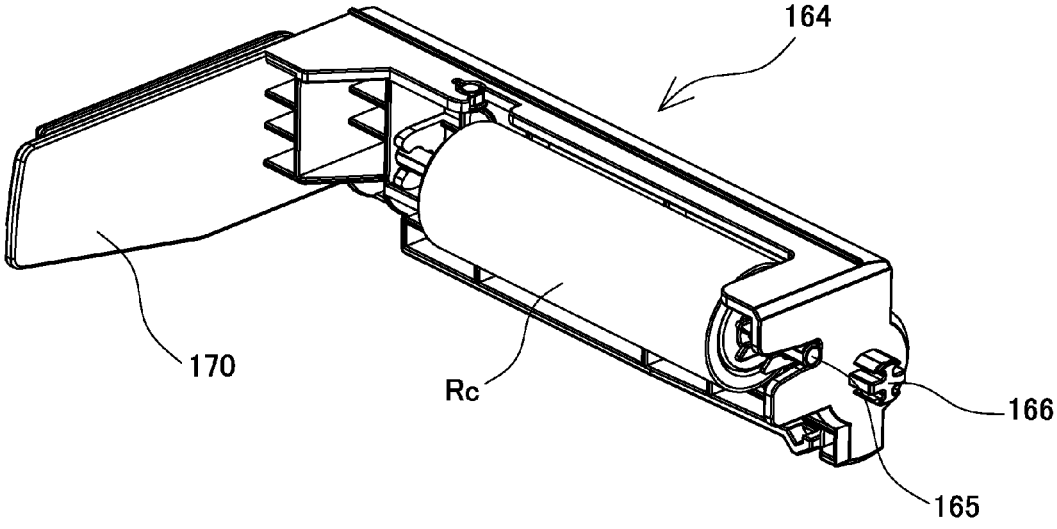
FIG. 19 is an explanatory view illustrating a cartridge storing a cleaning roller of the card cleaning mechanism.

In the present embodiment, each of the contact roller 22 and the cleaning roller Rc is stored in a holder member and is detachably attachable to the device along with the holder member as a cartridge type. The holder member which holds the pair of rollers 22*a*, 22*b* of the contact roller 22 structures a cartridge 163 (see FIG. 18). Meanwhile, a cartridge 164 (see FIG. 19) stores the cleaning roller Rc. Further, the holder member being the cartridge 164 is provided with a later-mentioned operation handle 170.

Each of the contact roller 22 and the cleaning roller Rc are structured with a roller body having cohesiveness at a surface thereof and a rotary shaft which is integrally formed with the roller body.

In the pair of contact rollers 22, the roller 22*b* is a drive roller and the roller 22*a* is a driven roller. While a recording card fed from the card storing section is conveyed to the turning unit F as being nipped by the pair of contact rollers 22, dust stuck on a surface thereof is removed.

The cleaning roller Rc having a surface contacted to a surface of the roller 22*a* of the contact roller 22 is rotated as being interlocked with the contact roller 22 so as to remove dust stuck on the surface of the contact roller 22 removing from a surface of a recording card. Here, viscosities of surfaces of the three rollers are set in ascending order from the right side toward the left side in the drawing. That is, the viscosity of the cleaning roller Rc is the largest.

The contact roller 22 and the cleaning roller Rc can be detached from the device frame 110 for replacement or maintenance respectively as each of the cartridges 163, 164 which store the rollers separately.

The cartridge 164 for storing the cleaning roller Rc is provided with an operation member 161 which separates the roller surface from the contact roller 22 in an attached state at the attaching opening 174 of the device frame 110, and a cover member 162 which prevents the contact roller from being separated from the attaching opening 174. The operation member 161 and the cover member 162 structure the operation handle 170 in an integrated manner.

The cartridge 164 includes a support shaft 166 which is different from a rotary shaft 165 of the cleaning roller Rc. The support shaft 166 is supported by a shaft receiving portion 185 at the attaching opening 174 of the device frame 110 and is movable between a locking posture position and a releasing posture position owing to an operation of the operation handle 170. When the operation handle 170 is at locking posture, the cartridge 163 which stores the contact roller 22 is prevented from being detached through the attaching opening 174. When the operation handle 170 is at releasing posture, the surface of the cleaning roller Rc is separated from the surface of the contact roller 22 and the cartridge 164 can be pulled out through the attaching opening 174.

Further, the device frame 110 is provided with a compression spring 176 which causes the surface of the cleaning roller Rc to contact to the surface of the contact roller 22. Owing to that the cartridge 164 is swung against the compression spring 176 about the support shaft 166 with an operation of the operation member 161, the cleaning roller Rc can be separated from the surface of the contact roller 22.

A cover member 167 is arranged to prevent the cartridge 164 which stores the cleaning roller Rc from being inserted to the device frame 110 when the cartridge 163 which stores the contact roller 22 is not attached to the device frame 110. The cover member 167 is swingably arranged at a shaft 168 of the device frame 110 and includes a cam member 169. When the cartridge 163 is not inserted, the cover member 167 is urged to an engaging position by a spring (not illustrated) to prevent the cartridge 164 (the cleaning roller Rc) from being attached. When the cartridge 163 is inserted through the attaching opening 174 and contacts to the cam member 169, the cover member 167 is at a releasing position to allow the cartridge 164 to be attached.

Figure 24:
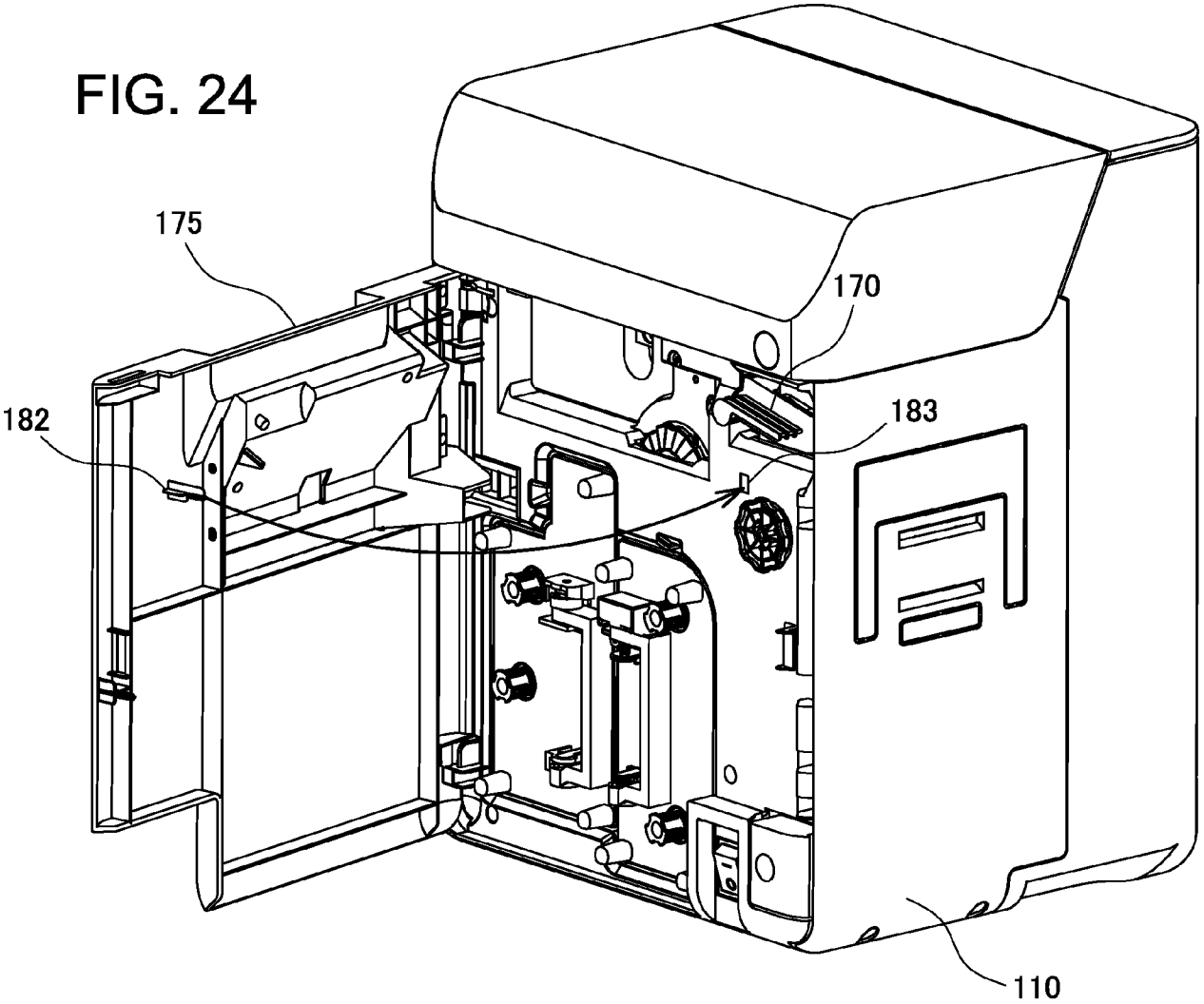
FIG. 24 is an explanatory view illustrating an operation of an interlock member.

An interlock member 171 is arranged to the device frame 110 as being axially supported by a shaft 181 in a rotatable manner. When the cartridge 164 is not inserted (see FIGS. 20 and 21) or when the cartridge is inserted and the operation handle 170 is at the releasing posture (see FIG. 22), the interlock member 171 is at a position to close the attaching opening 174 which is formed at a front face of the device frame 110 as being urged by a spring 172. In this state, a pin 182 arranged at an open-close cover 175 which opens and closes the front face of the device frame 110 cannot be inserted to the opening 183, so that the open-close cover 175 cannot close the front face of the device frame 110, as illustrated in FIG. 24.

In contrast, when the cartridge 164 is inserted through the attaching opening 174 and the operation handle 170 is at the locking posture (see FIG. 23), the interlock member 171 is rotated against the spring 172 as being pushed by the cartridge 164 and the opening 183 formed at the front face of the device frame 110 is opened. Accordingly, the pin 182 of the open-close cover 175 can be inserted to the opening 183 and the open-close cover 175 can close the front face of the device frame 110.

Operations of the cover member 167, the operation handle 170, and the interlock member 171 in the above structure will be described based on FIGS. 20 to 23.

Figure 20:
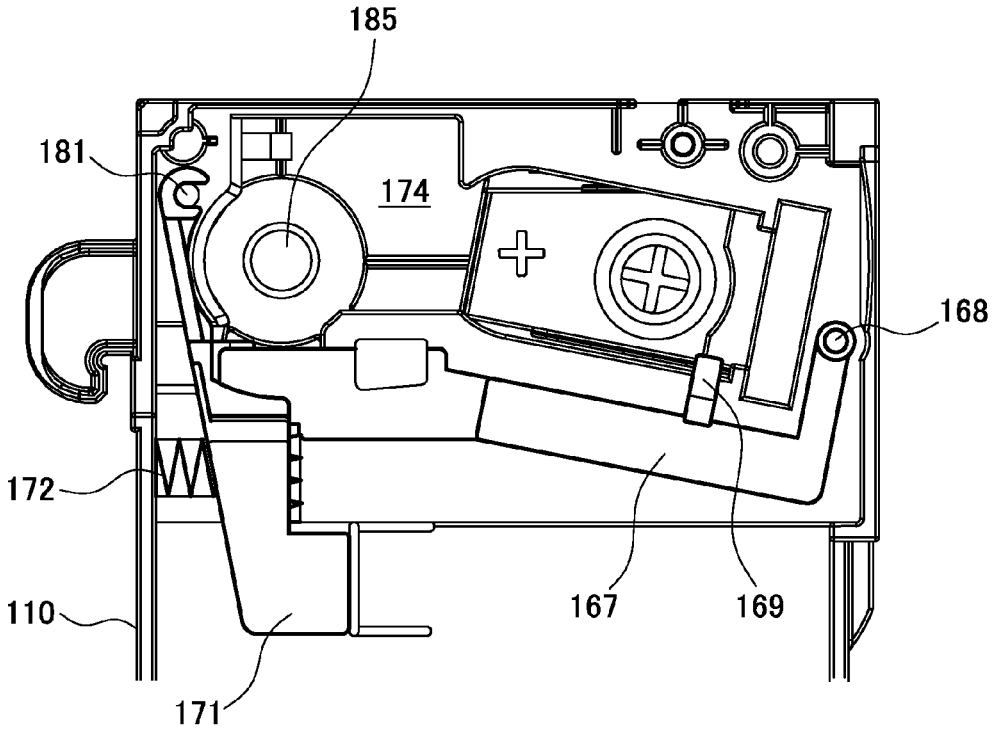
FIG. 20 is a front view of the printer in a state that the contact roller and the cleaning roller are detached.

FIG. 20 illustrates a state that the cartridge 163 and the cartridge 164 are not attached. The cover member 167 is spring-urged by the spring to the engaging position to prevent the cartridge 164 (cleaning roller Rc) form being attached through the attaching opening 174. At that time, it is possible to attach the cartridge 163. Here, the interlock member 171 is at a position to close the opening 183 as being urged by the spring 172.

Figure 21:
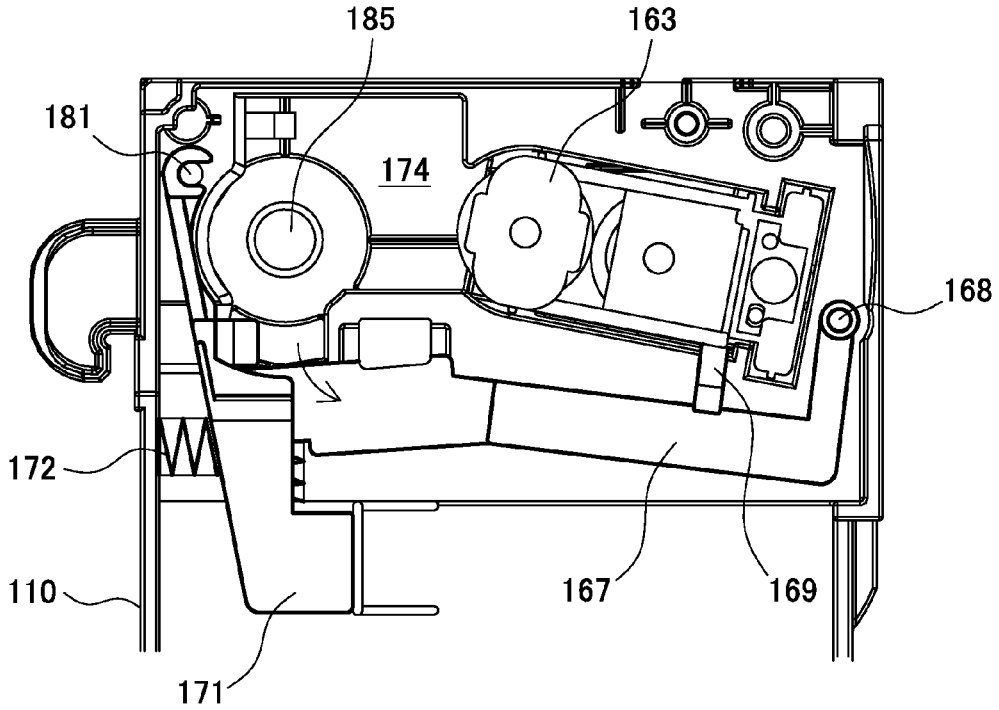
FIG. 21 is a front view of the printer in a state that the contact roller is attached.

In a state of FIG. 21 that the cartridge 163 is inserted from the state of FIG. 20, the cover member 167 is swung downward owing to contact between the cartridge 163 and the cam member 169 to be at the releasing position to allow attaching of the cartridge 164 as retreating from the attaching opening 174. Thus, in a case of attaching the contact roller 22 and the cleaning roller Rc, the cleaning roller Rc is attached after the contact roller 22 is attached.

Figure 22:
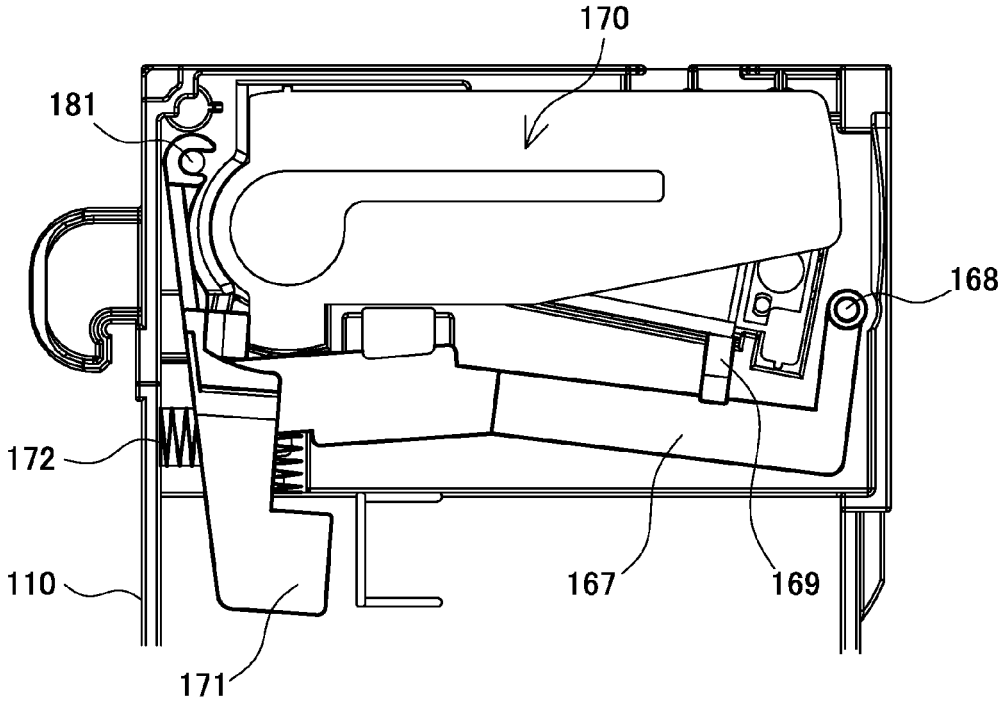
FIG. 22 is a front view of the printer in a state that the cleaning roller is attached.

FIG. 22 illustrates a state that the cartridge 164 is inserted through the attaching opening 174. In this state, the operation handle 170 arranged at the cartridge 164 is at the releasing posture and the surface of the cleaning roller Rc and the surface of the contact roller 22 are separated.

Figure 23:
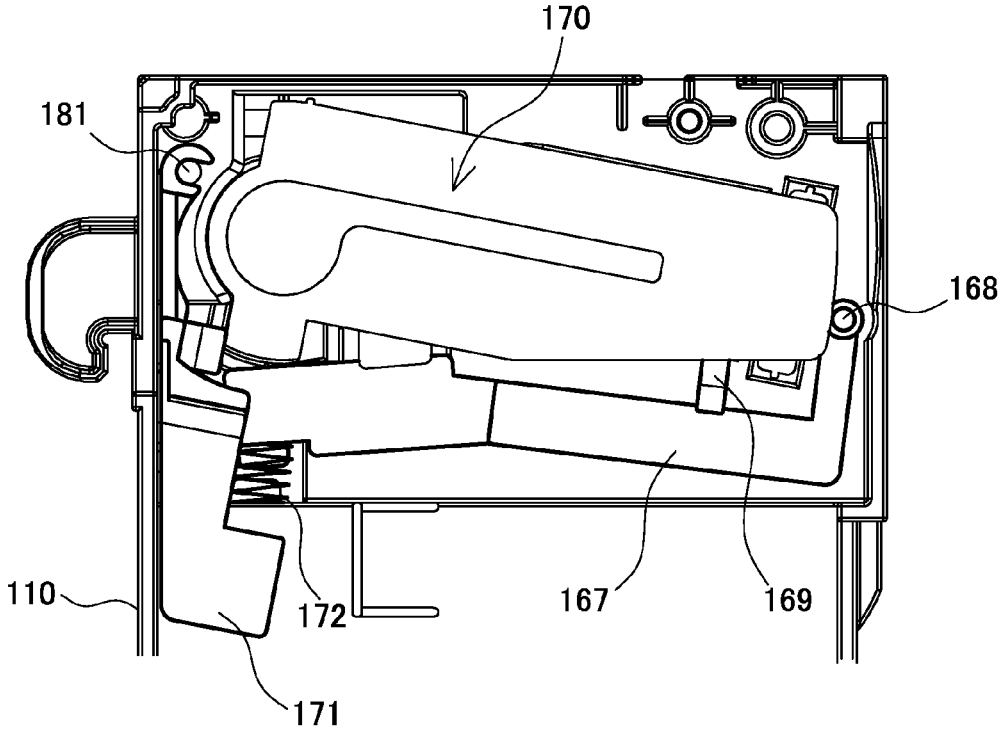
FIG. 23 is a front view illustrating a state that the attached contact roller and cleaning roller are further contacted.

When the operation handle 170 is rotated downward about the shaft 166 (see FIG. 19), the state of FIG. 22 shifts to a state of FIG. 23. In this state, the surface of the cleaning roller Rc contacts to the surface of the contact roller 22, so that cleaning operation of a recording card can be performed. At that time, the pull-out side of the cartridge 163 is covered by the cover member 167 as a result of downward rotation of the operation handle 170, so that the cartridge 163 cannot be pulled out from the device frame 110. Subsequently, the interlock member 171 is rotated as being pushed by the cartridge 164 and the opening 183 at the front face of the device frame 110 is opened. Accordingly, when the open-close cover 175 is closed, the front face of the device frame 110 can be closed while the pin 182 is inserted to the opening 183.

The above is the operations for attaching the contact roller 22 and the cleaning roller Rc. For detaching the rollers from the device frame 110, operations are performed reversely from the state of FIG. 23. That is, the surface of the cleaning roller Rc and the surface of the contact roller 22 are separated by rotating the operation handle 170 upward to be in the state of FIG. 22. Then, the cartridge 164 is pulled out and closing with the cover member 167 is released, so that the cartridge 163 can be pulled out. Thus, detaching of the cleaning roller Rc and the contact roller 22 is performed in the order thereof.

As described above, the contact roller 22 and the cleaning roller Rc, surfaces of which have cohesiveness, are attached to and detached from the device separately. According to the present invention, in a case of attaching, the contact roller 22 and the cleaning roller Rc are required to be attached in the order thereof owing to an action of the cover member 167. In a case of detaching, the cleaning roller 22 and the contact roller Rc are reliably separated by an action of the operation handle 170 and are required to be detached in the order thereof owing to the cover member 162. Accordingly, the cleaning roller 22 and the contact roller Rc can be attached and detached separately and reliably.

In addition, the open-close cover 175 cannot be closed unless the contact roller 22 and the cleaning roller Rc are contacted with operation of the operation handle 170. Accordingly, it is possible to avoid to forget attaching of the cleaning roller Rc and to restart the device in a state that the contact roller 22 and the cleaning roller Rc are detached.

According to the above structure, since the contact roller is required to be attached before attaching the cleaning roller to the device, there is not a fear to forget attaching of the contact roller and the plurality of rollers can be reliably attached to the device. Meanwhile, since the operation member is attached to the cleaning roller to release cohesive contact between the rollers, the respective rollers can be easily attached to the device. After the attaching, the cleaning roller and contact roller can be cohesively contacted.

Further, since the cover member which prevents the contact roller from being detached through the attaching opening is arranged at the cleaning roller, there in not a fear that the contact roller is pulled out in a state that the rollers are cohesively contacted when the respective roller units are to be detached from the device. Accordingly, a roller surface can be prevented from being damaged by a false operation.

Furthermore, the open-close cover which opens and closes the card conveyance passage is arranged at the device housing and opening-closing of the cover is prohibited when the operation member of the cleaning roller is in a non-contacted state. Accordingly, it is possible to alarm that the cleaning roller and the contact roller are not attached into the device when the open-close cover cannot be closed.

Industrial Applicability

The present invention relates to a printer which records electronic information or image information on a recording medium such as a plastic card and a thick paper card. Accordingly, the present invention has industrial applicability.

EXPLANATION OF REFERENCES

32*a*, 32*b*: Pinch roller
34: Peeling koro (Peeling roller)
35: Pinch roller
40: Thermal head
41: Ink ribbon
42: Cassette (Ribbon cassette)
45: Platen roller
46: Transfer film
47: Winding roll (Winding spool)
48: Feeding roll (Feeding spool)
49: Film conveying roller
50: Bracket (Second bracket)
50A: Bracket (First bracket)
51: Spring member (Second spring member)
52: Tension receiving member (Second tension receiving member)
52A: Tension receiving member (First tension receiving member)
53: Cam (Second cam)
53A: Cam (First cam)
72: Platen support member
91: First unit
92: Second unit
93: Third unit
100: Film cassette

The invention claimed is:

1. A printer in which an ink ribbon and a transfer film are fed to a print position between a platen roller and a thermal head which are mutually pressure-contacted and an image is formed on the transfer film, comprising:

a feeding spool which winds an unused portion of the transfer film;

a winding spool which winds a used portion of the transfer film;

a film cassette which holds the feeding spool and the winding spool as being detachably attachable to a device frame;

a peeling member which separates the transfer film and the ink ribbon from an overlapped state and conveys the transfer film and the ink ribbon respectively in two different directions as being arranged at the downstream side of the platen roller;

a film conveying roller which is fixedly arranged at the downstream side of the peeling member and at the inside of the film cassette with respect to the transfer film;

a pinch roller which is arranged at a position being faced to the film conveying roller while sandwiching the transfer film and which is movable between a pressure-contact position to cause the transfer film to be pressure-contacted to the film conveying roller and a separation position to be separated from the transfer film; and drive means which rotationally drives the film conveying roller, wherein the transfer film is displaced by a predetermined amount to the inside of the film cassette and is pressure-contacted to the film conveying roller by moving the pinch roller from the separation position to the pressure-contact position, and the image is formed on the transfer film while the transfer film is conveyed with rotation of the film conveying roller.

2. The printer according to claim 1, wherein the platen roller is arranged at the inside of the film cassette with respect to the transfer film, the thermal head is fixedly arranged at a position being faced to the platen roller as sandwiching the transfer film and the ink ribbon, the platen roller is configured to be movable between a non-print position where the platen roller is separated from the transfer film and the print position where the image is formed on the transfer film while nipping the transfer film and the ink ribbon with thermal head, and the transfer film is displaced to the outside of the cassette film by a predetermined amount by moving the platen roller from the non-print position to the print position.

3. The printer according to claim 2, wherein the platen roller is held by a first bracket which advances toward the thermal head with rotation of a first cam, the pinch roller which is structured with a pair of pinch rollers arranged at the upstream side and the downstream side along a film conveyance passage for conveying the transfer film and which is held by a second bracket which advances toward the film conveying roller with rotation of a second cam, a first spring member which urges the platen roller held by the first bracket to be pressed to the thermal head and a second spring member which urges the pair of pinch rollers held by the second bracket to be pressed to the film conveying roller are provided, the film conveying roller, the first cam, and the first bracket are integrated as a first unit, and the second cam and the second bracket are integrated as a second unit.

4. The printer according to claim 2, wherein the peeling member includes a pair of rollers which nip the transfer film and the ink ribbon in an overlapped state, and one roller is arranged as being capable of being pressure-contacted to and separated from the other roller and is pressure-contacted and separated as being interlocked with the platen roller which moves from the non-print position to the print position.

5. The printer according to claim 3, wherein the peeling member includes a pair of rollers which nip the transfer film and the ink ribbon in an overlapped state, and one roller is arranged as being capable of being pressure-contacted to and separated from the other roller while being held by the first bracket and is pressure-contacted and separated as being interlocked with the platen roller which moves from the non-print position to the print position.

6. The printer according to claim 2, wherein contacting-separating motion of the platen roller against the thermal head and the contacting-separating motion of the pinch roller against the film conveying roller are caused by a common drive source.

7. The printer according to claim 3, wherein the first cam and the second cam are driven by a common drive source.

8. The printer according to claim 3, wherein the thermal head is arranged as a third unit.

9. The printer according to claim 3, wherein the platen roller is held by a pair of platen support members which supports both ends of the platen roller respectively, and the platen support members are held by the first bracket via the first spring member.

10. The printer according to claim 9, wherein the first bracket and the platen support members are interlocked as having space in which the first cam and the first spring member are arranged.

11. The printer according to claim 3, wherein the pair of pinch rollers are supported by both ends of a pinch roller support member which is held rotatably at a center part thereof by the second bracket.

12. The printer according to claim 11, wherein one end of the second bracket which is supported axially at a midpoint thereof moves the supported pinch roller support member toward the film conveying roller when the second bracket is rotated with the other end thereof urged by the second cam.

13. The printer according to claim 3, wherein the second bracket includes a tension receiving member which is contacted to the transfer film so as to absorb a tensile force of the transfer film being repulsive to pressure-contact when the pinch roller is pressure-contacted to the film conveying roller via the transfer film.

14. The printer according to claim 1, wherein a friction coefficient of the film conveying roller against the transfer film is set higher than a friction coefficient of the platen roller against the transfer film.

15. The printer according to claim 1, wherein hardness of the platen roller is set higher than hardness of the film conveying roller.

16. The printer according to claim 2, wherein a guide roller which conveys the ink ribbon and the transfer film to the print position in an overlapped state is arranged at the upstream side of the platen roller, and a pressure-contact point between the platen roller and the thermal head is arranged at a position being offset by a predetermined amount to the outside of the film cassette and a pressure-contact point between the film conveying roller and the pinch roller is offset by a predetermined amount to the inside of the film cassette, with respect to a line connecting the guide roller and the peeling roller.

17. The printer according to claim 4, wherein the other roller of the peeling member is fixed to a ribbon cassette which stores the ink ribbon.

18. The printer according to claim 1, wherein the ink ribbon peeled by the peeling member is wound in an oblique direction toward the outside of the film cassette, and the transfer film and the ink ribbon passed through the peeling member are conveyed in mutually separating directions.

19. The printer according to claim 18, wherein a winding roll of the ink ribbon is arranged at a position being faced to the film conveying roller as sandwiching the pinch roller at the separation position.

* * * * *